US009953480B2

(12) United States Patent
Roekens et al.

(10) Patent No.: US 9,953,480 B2
(45) Date of Patent: Apr. 24, 2018

(54) MERCHANDISER WITH PRODUCT DISPENSING CHUTE MECHANISM

(71) Applicant: The Coca-Cola Company, Atlanta, GA (US)

(72) Inventors: Jurgen Roekens, Kapenhout (BE); Abram C. Knip, Heemstede (NL); Jacobus P. M. Dessing, Hoofddorp (NL)

(73) Assignee: The Coca-Cola Company, Atlanta, GA (US)

( * ) Notice: Subject to any disclaimer, the term of this patent is extended or adjusted under 35 U.S.C. 154(b) by 0 days.

(21) Appl. No.: 15/107,231

(22) PCT Filed: Dec. 23, 2014

(86) PCT No.: PCT/US2014/072014
§ 371 (c)(1),
(2) Date: Jun. 22, 2016

(87) PCT Pub. No.: WO2015/100276
PCT Pub. Date: Jul. 2, 2015

(65) Prior Publication Data

US 2017/0024950 A1 Jan. 26, 2017

Related U.S. Application Data

(60) Provisional application No. 61/919,894, filed on Dec. 23, 2013.

(51) Int. Cl.
*G07F 11/22* (2006.01)
*G07F 9/10* (2006.01)
(Continued)

(52) U.S. Cl.
CPC ..... *G07F 11/165* (2013.01); *G07F 9/105* (2013.01); *G07F 11/22* (2013.01); *G07F 11/40* (2013.01); *G07F 11/42* (2013.01)

(58) Field of Classification Search
None
See application file for complete search history.

(56) References Cited

U.S. PATENT DOCUMENTS 5,020,958 A * 6/1991 Tuttobene ..... G07F 7/069 221/88
6,247,610 B1 6/2001 Ziesel et al.
(Continued)

OTHER PUBLICATIONS

International Search Report and Written Opinion for International Application No. PCT/US2014/072014 dated Apr. 17, 2015.
(Continued)

*Primary Examiner* — Timothy Waggoner
*Assistant Examiner* — Ayodeji Ojofeitimi
(74) *Attorney, Agent, or Firm* — Eversheds Sutherland (US) LLP

(57) ABSTRACT

The present application provides a merchandiser. The merchandiser may include a temperature controlled compartment, a product input system adjacent to the temperature controlled compartment, and a multi-chute product dispensing mechanism positioned within the temperature controlled compartment. The multi-chute product dispensing system may include a number of product chutes in communication with a dispense activation mechanism.

14 Claims, 29 Drawing Sheets

(51) Int. Cl.

| | |
|---|---|
| ***G07F 11/16*** | (2006.01) |
| ***G07F 11/40*** | (2006.01) |
| ***G07F 11/42*** | (2006.01) |

(56) References Cited

U.S. PATENT DOCUMENTS

| | | | | |
|---|---|---|---|---|
| 6,467,648 | B1 * | 10/2002 | Nishiyama | G07F 11/06 221/289 |
| 7,055,716 | B2 * | 6/2006 | Holdway | G07F 11/165 221/131 |
| 2004/0011751 | A1 | 1/2004 | Johnson et al. | |
| 2004/0030444 | A1 * | 2/2004 | Hieb | G07F 9/026 700/236 |
| 2008/0135574 | A1 * | 6/2008 | Hieb | G07F 11/10 221/123 |
| 2011/0147323 | A1 | 6/2011 | Sainato et al. | |
| 2012/0000927 | A1 * | 1/2012 | Carpentier | A47F 3/0491 221/1 |
| 2013/0134119 | A1 | 5/2013 | Loftin et al. | |

OTHER PUBLICATIONS

International Preliminary Report on Patentability dated Jun. 28, 2016 for International Application No. PCT/US2014/072014.

* cited by examiner

MERCHANDISER WITH PRODUCT DISPENSING CHUTE MECHANISM

TECHNICAL FIELD

The present application and the resultant patent relate generally to merchandisers such as coolers and other types of product dispensers and more particularly relate to a merchandiser with a product dispensing chute mechanism positioned within a temperature controlled compartment so as to dispense a temperature controlled product upon receiving an ambient product.

BACKGROUND OF THE INVENTION

Generally described, a merchandiser such as an open front cooler may include a refrigerated open enclosure with a number of chilled products within the reach of a consumer. Because open front coolers offer such quick and easy accessibility and proximity to the chilled products therein, such coolers often spur impulse purchases by consumers. As a result, open front coolers may provide an increase in sales volume as compared to a conventional glass door merchandiser and the like having the same size and/or in similar locations. An open front cooler also may provide an increase in sales volume as compared to similar products stored at ambient temperatures on conventional product shelves or elsewhere.

One drawback with conventional open front coolers, however, is that the cooler may consume several times more energy as compared to a glass door merchandiser of the same size due to the lack of a door or other type of insulated front space to keep the cold air from escaping. The increased sales revenue generally provided by an open front cooler thus may not cover or justify the resulting increase in energy costs. Moreover, there is an ever increasing demand for energy efficient and "green" devices. Maintain a large inventory of cold products for an extended period of time may not be energy efficient.

There is thus a desire for an improved cooler, merchandiser, and the like that promotes impulse purchases with easy accessibility such as in an open front cooler but with the improved efficiency and the reduced energy costs of a glass door merchandiser, a chest cooler, and the like. The merchandiser thus may dispense a temperature controlled product upon receipt of an ambient product so as to limit the number of products to be cooled therein.

SUMMARY OF THE INVENTION

The present application and the resultant patent thus provide a merchandiser. The merchandiser may include a temperature controlled compartment, a product input system adjacent to the temperature controlled compartment, and a multi-chute product dispensing mechanism positioned within the temperature controlled compartment. The multi-chute product dispensing system may include a number of product chutes in communication with a dispense activation mechanism.

The present application and the resultant patent further provide a method of dispensing a temperature controlled product upon receiving an ambient product. The method may include the steps of optically identifying the ambient product, releasing the identified ambient product into a temperature controlled compartment, delivering the identified ambient product to a predetermined product chute with a corresponding temperature controlled product, activating the predetermined product chute, and dispensing the corresponding temperature controlled product.

The present application and the resultant patent further provide a merchandiser. The merchandiser may include a temperature controlled compartment and a product dispensing chute mechanism positioned within the temperature controlled compartment. The product dispensing chute may include an upper loading mechanism and a lower separation mechanism connected by a tow bar. The tow bar may be spring loaded. The upper loading mechanism and the lower separation mechanism may cooperate via the spring loaded tow bar to dispense a temperature controlled product upon receipt of an ambient product.

The present application and the resultant patent further provide a method of dispensing a product from a merchandiser. The method may include the steps of maneuvering a lever to open a first pair of stopper plates and close a second pair of stopper plates so as to drop a first product into a bottom column position on the pair of second stopper plates, inserting a second product into a top column position, and maneuvering the lever to open the second pair of stopper plates to dispense the first product from the bottom column position and close the first pair of stopper plates to accept a third product thereon.

The present application and the resultant patent further provide a super-chill merchandiser. The super-chill merchandiser may include an outer shell, a super-chill refrigeration system, a dispensing wheel positioned within the outer shell, and a ratchet mechanism to advance the dispensing wheel. The ratchet mechanism may advance the dispensing wheel to dispense a super-chilled product.

These and other features and improvements of the present application and the resultant patent will become apparent to one of ordinary skill in the art upon review of the following detailed description when taken in conjunction with the several drawings and the appended claims.

DETAILED DESCRIPTION

The present application concerns the offer for sale or other use of any number of products 10. Although the products 10 are shown, by way of example only, in the form of bottles, it is understood that the products 10 may include any type or size of container including, but not limited to, bottles, cans, pouches, boxes, wrapped items, and/or any type of rigid or flexible packaging. The products 10 may include beverages, food items, non-food items, consumer products, and/or any type of product 10 that may be positioned on a shelf and/or that may be vended. Similarly, while one use herein is for a chilled product 10, it will be understood that the products 10 herein may be at ambient, refrigerated, frozen, heated, or at any desired temperature or state. As will be described in more detail below, the products 10 herein may take the form of ambient products 20 and temperature controlled products 30. The ambient products 20 and the temperature controlled products 30 may or may not be the same products 10. Other product variations may be used herein. The scope of this application and the claims herein are in no way limited by the nature of the products 10 intended to be used herein.

Figure 1:
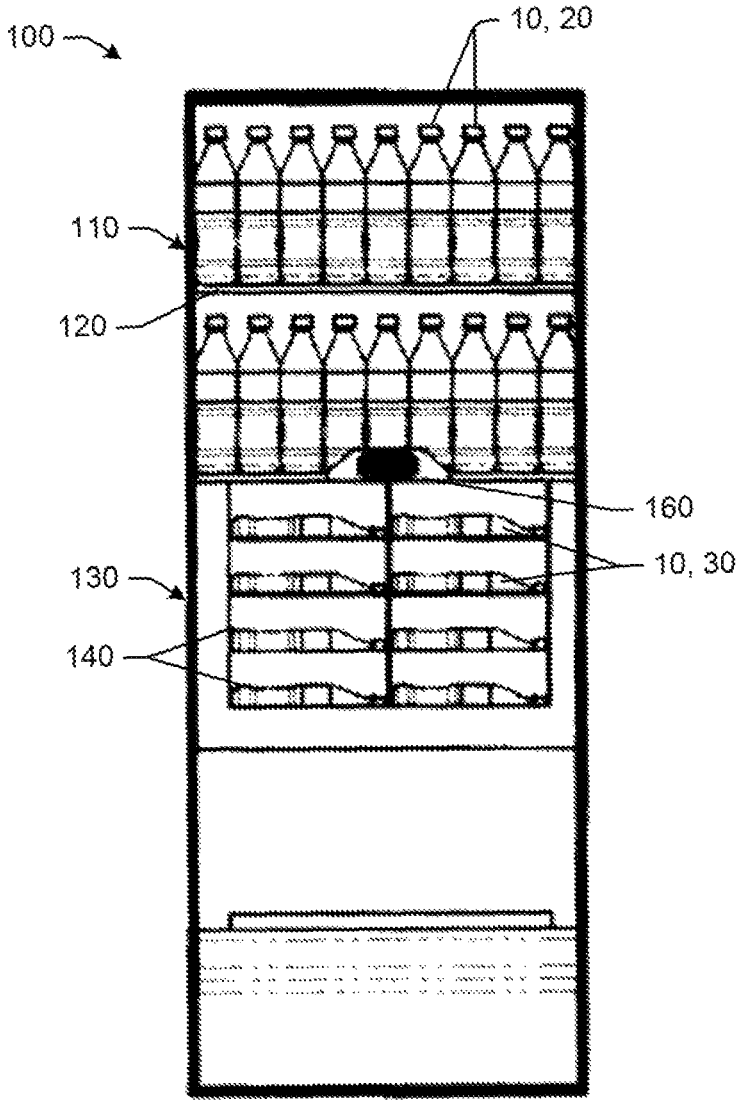
FIG. 1 is a front plan view of a merchandiser with a number of products as may be described herein.
Figure 2:
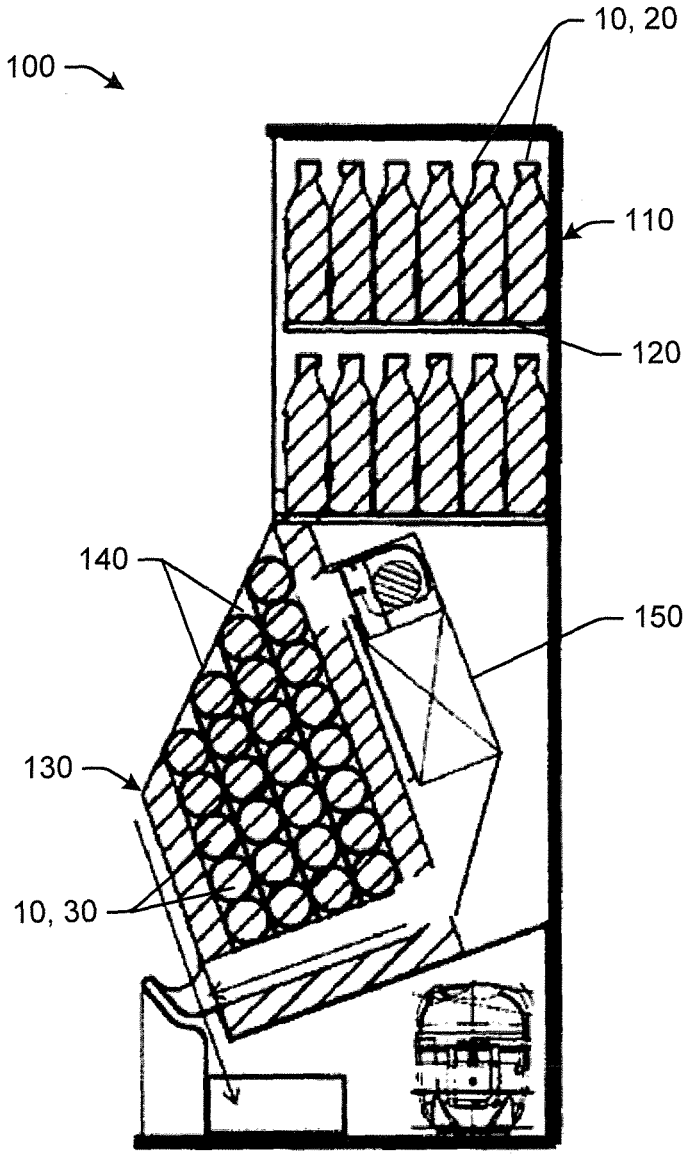
FIG. 2 is a side sectional view of the merchandiser of FIG. 1 showing the refrigeration components.
Figure 3:
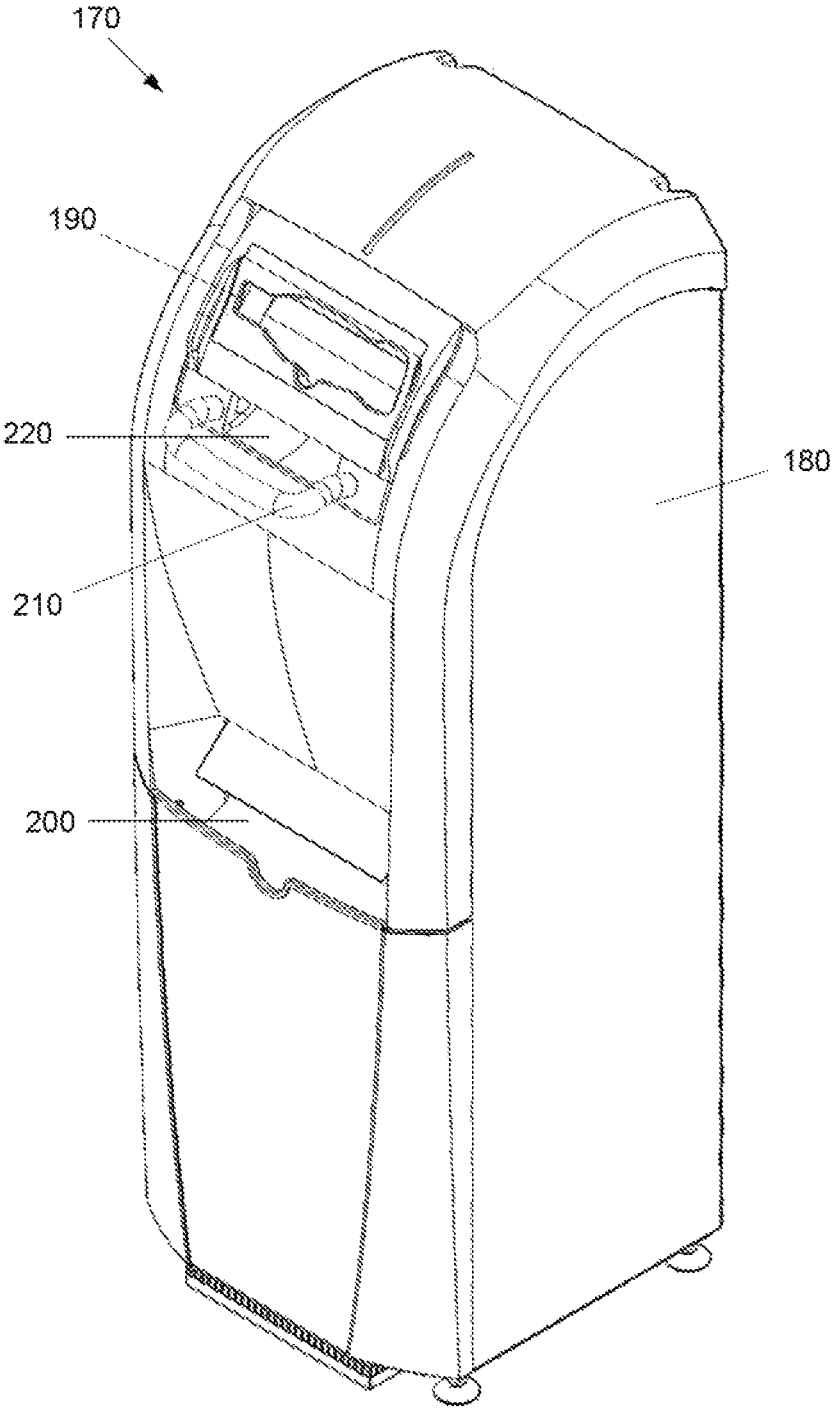
FIG. 3 is a perspective view of a further embodiment of a merchandiser as may be described herein.
Figure 4:
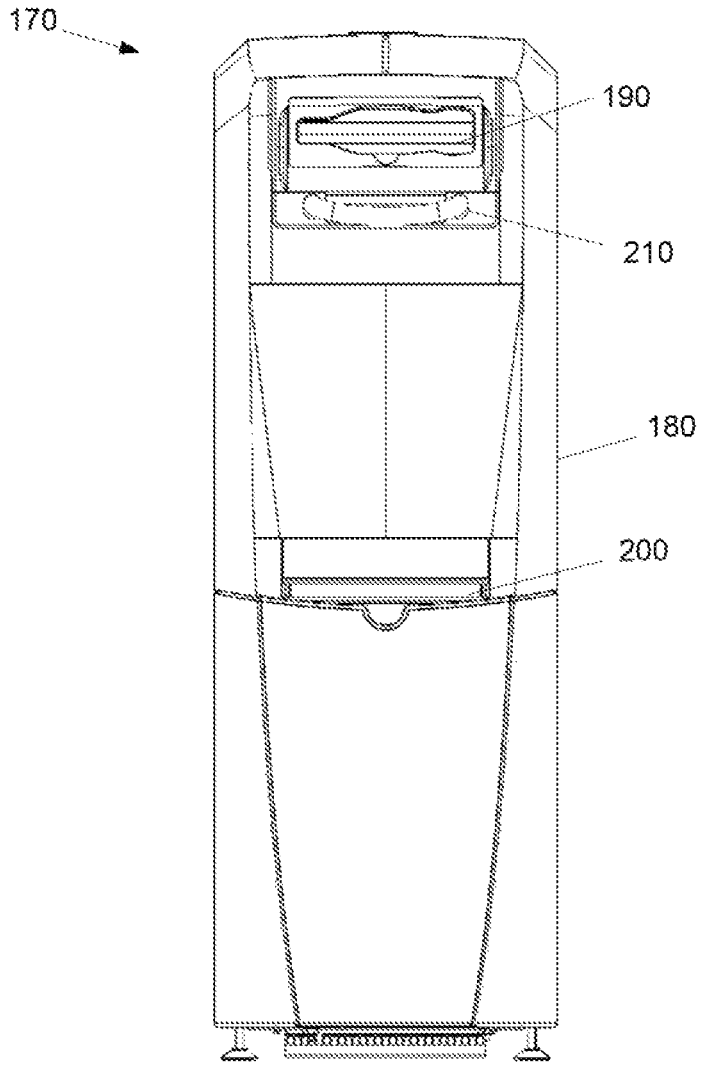
FIG. 4 is a front plan view of the merchandiser of FIG. 3.
Figure 5:
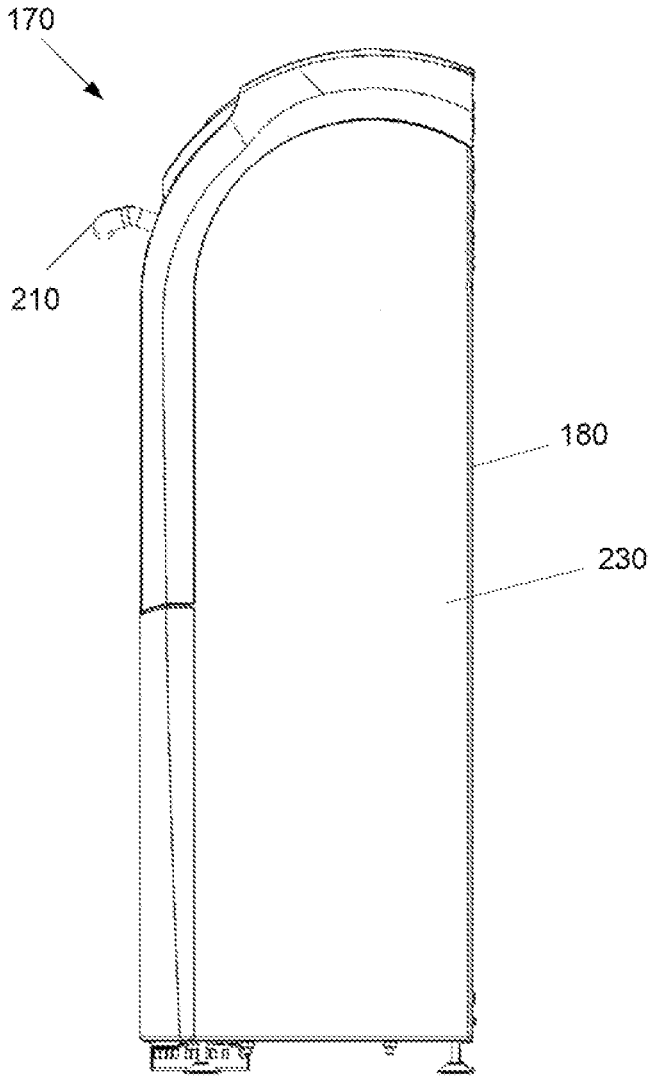
FIG. 5 is a side plan view of the merchandiser of FIG. 3.
Figure 6:
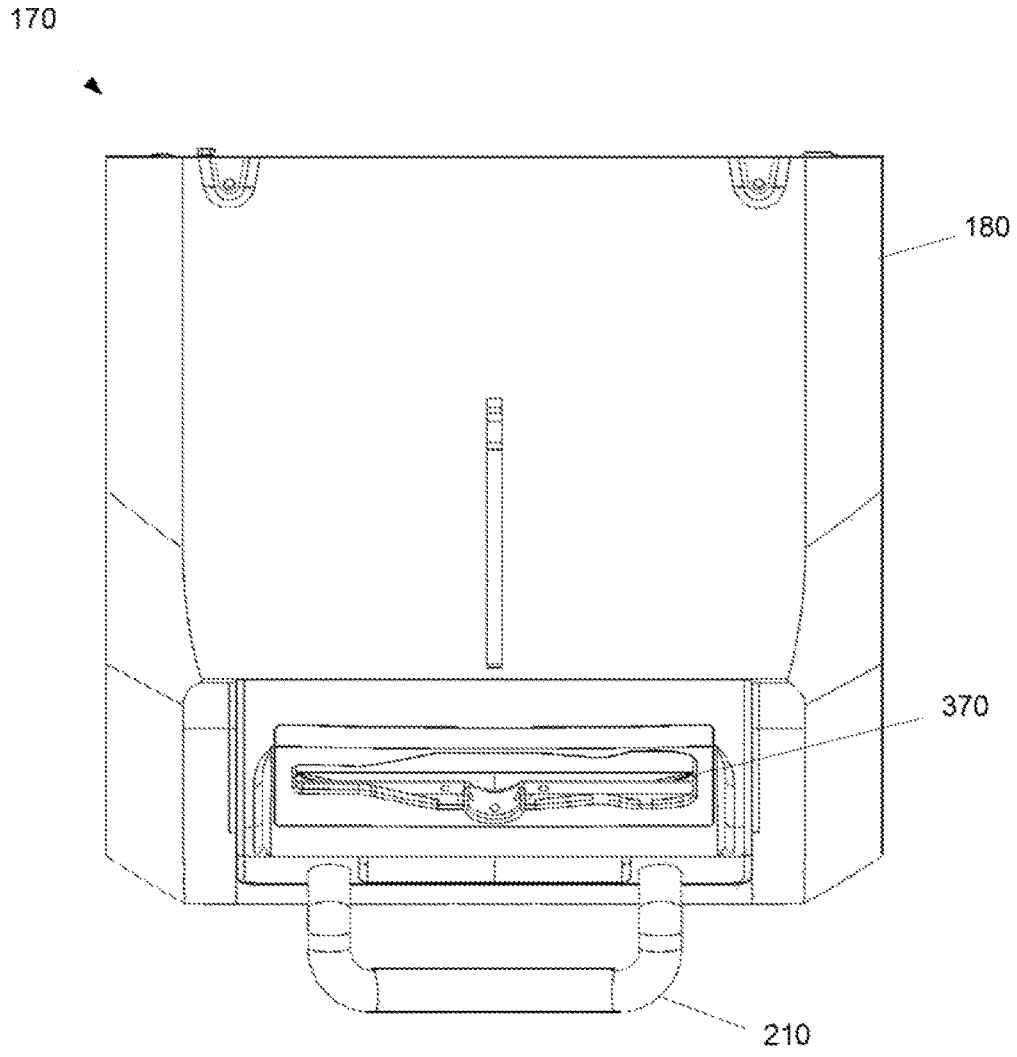
FIG. 6 is a top plan view of the merchandiser of FIG. 3.

Referring now to the drawings, in which like numerals refer to like elements throughout the several views, FIGS. 1 and 2 show a merchandiser 100 as may be described herein. The merchandiser 100 may include one or more open or ambient compartments 110. Each ambient compartment 110 may include a number of open or ambient compartment shelves 120. Any number of the ambient compartment shelves 120 may be used. The ambient compartment 110 and the ambient compartment shelves 120 may have any suitable size, shape, or configuration. Any number of the products 10 may be placed on the ambient compartment shelves 120. The ambient compartment shelves 120 may be flat or may be any type of structure that supports the products 10 such as angled shelves, gravity fed shelves, neck tracker tubes, product chutes, and the like. Likewise, vertical columns and conventional vending columns may be used. At least the front of the ambient compartment 110 may be open to allow for substantially unimpeded access to the products 10 on the ambient compartment shelves 120. The ambient compartment 110 and the products 20 therein may be maintained at an ambient temperature. Part of or the entire ambient compartment 110, however, may be heated, cooled, or otherwise temperature controlled on an intermittent or a temporary basis. Other components and other configurations may be used herein.

The merchandiser 100 also may include a temperature controlled compartment 130. The temperature controlled compartment 130 may be substantially enclosed and/or insulated. The temperature controlled compartment 130 may have any number of product dispensing chute mechanisms 140 positioned therein. Examples of the product dispensing chute mechanisms 140 will be described in more detail below. The temperature controlled compartment 130 also may have other types of support structures therein, such as flat shelves, angled shelves, gravity fed shelves, neck tracker tubes, product chutes, and the like. Although the temperature controlled compartment 130 shown in FIGS. 1 and 2 is integral with the ambient compartment 110, it is to be understood that the temperature controlled compartment 130 may operate as a standalone unit such that ambient products 20 on traditional store shelves and the like may be used with the temperature controlled compartment 130. The temperature controlled compartment 130 may be at any desired temperature from freezing, chilled, ambient, warm, or hot. The temperature controlled compartment may be in communication with a conventional heating/cooling module 150 and the like. Multiple temperature controlled compartments 130 with multiple temperatures also may be used herein. Other components and other configurations may be used herein.

The temperature controlled compartment 130 and/or the ambient compartment 110 may include a scanner or other type of identification module 160. The identification module 160 may include an optical recognition device, a barcode scanner, an RFID tag reader, photoelectric cells, and/or any type of device that may read indicia on the product 10, identify the shape of the product 10, or otherwise identify or receive the identity of the product 10. For example, a camera may read the label or the cap on a bottle for identification. Alternative, the liquid level in the bottle, the color of the fluid within the bottle, or other types of indicia may be used. This process has the advantage of the label and the cap always being in the same location as well as having the ability to spot foreign items along with a valid product for improved reliability. Alternatively, the identity of the product 10 may be entered or otherwise indicated by a consumer such as by pressing a product selection button and the like. Other types of selection means may be used herein. Although the identification module 160 is shown as being positioned adjacent to the temperature controlled compartment 130, the identification module 160 may be positioned in any convenient location. The identification module 160 also may reject or refuse to accept a product 10 that is not intended to be used with the merchandiser 100 as a whole. Other components and other configurations may be used herein.

FIGS. 3-9 shown an example of a merchandiser 170 as may be described herein. As is shown, the merchandiser 170 may include an outer shell 180. The outer shell 180 may be made out of any type of substantially rigid material and may have any suitable size, shape, or configuration. The outer shell 180 may be insulated in whole or in part. The merchandiser 170 may include an input port 190, a dispensing port 200, a dispensing lever 210, and a reject port 220. The ports 190, 200, 220 and the dispensing lever 210 may have any suitable size, shape, or configuration. The merchandiser 170 also may have a temperature controlled compartment 230 therein. The temperature controlled compartment 230 may have any suitable size, shape, or configuration. The merchandiser 170 may have one or more product dispensing chute mechanisms 140 positioned within the temperature controlled compartment 240. In this example, a dual chute product dispensing mechanism 230 may be positioned therein.

In some embodiments, the merchandiser 170 may only house a single brand of products. In such embodiments, the input port 190 may be sized and shaped to correspond to the silhouette of the packaging of the single brand. Therefore, only products with the silhouette of the packaging of the single brand may be inserted into the merchandiser 170. In some embodiments, the merchandiser 170 may include the identification module 160 for ensuring that an ambient product 20 of the appropriate brand is inserted into the merchandiser 170. The identification module 160 may interact with a locking mechanism (not shown) that prevents activating the dispensing lever 210 unless the appropriate brand of product has been identified. Alternatively, the reject port 220 may be used as will be described in more detail below. Other components and other configurations may be used herein.

Figure 7:
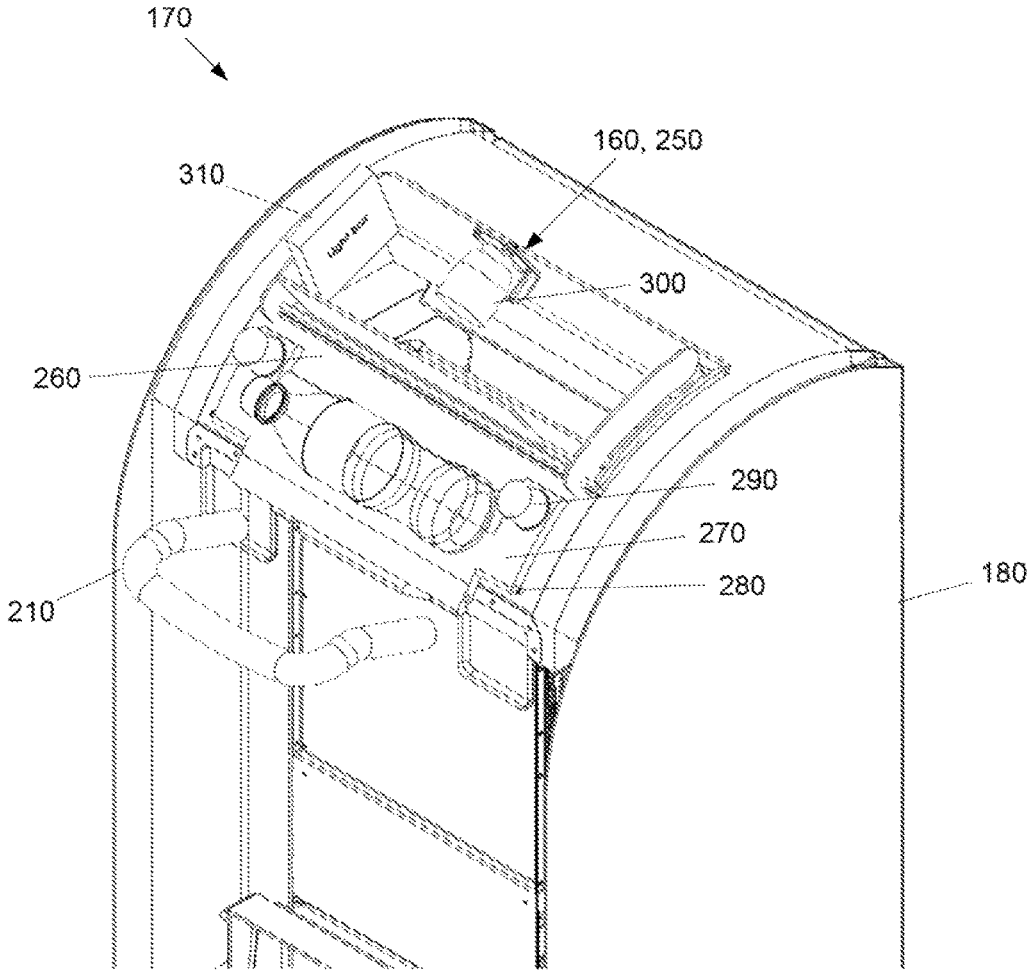
FIG. 7 is a perspective view of an optical recognition system that may be used with the merchandiser of FIG. 3.

FIG. 7 shows an example of an identification module 160 in the form of an optical recognition system 250. The merchandiser 170 may have an input cavity 260 positioned about the input port 190 and on top or adjacent to the temperature controlled compartment 230. A shuttle 270 may separate the input cavity 260 and the temperature controlled compartment 230. The shuttle 270 may pivot about a pivot rod 280 and the like. The shuttle 270 may open and close via a number of electromagnets 290. The shuttle 270 may have any suitable size, shape, or configuration. Other types of opening and closing devices may be used herein.

The optical recognition system 250 may include a camera 300. The camera 300 may be a conventional optical recognition device and the like. A main camera lighting source 310 may be used. A background lighting source (not shown) also may be used opposite the camera 300. The lighting sources may be of light emitting diodes or other types of conventional sources. The background lighting source may be a lower power lighting source than the camera lighting source 310. The background lighting source may include a number of lighting sources spaced apart at distinct locations along a surface opposite the camera 300 or otherwise in the view of the camera 300. The input cavity 260 may be positioned between the surface with the background lighting and the camera 300.

In operation, the camera 300 may periodically sample the scene or otherwise capture a sampling image of the scene and the optical recognition system 250 may determine whether or not the scene has changed with respect to a baseline sampling image. In some embodiments, the current sampling image captured by the camera 300 may be a low resolution image (e.g., an image captured based on sampling less than all of the available pixels on the camera 300 or otherwise less than a maximum resolution of the camera 300 or less than a resolution of a detection image captured by camera 300 while the camera lighting source 310 is activated). The changes between a current sampling image and the baseline sampling image determined by the optical recognition system 250 may include detecting that one or more of the background lighting sources is blocked or otherwise not detected in the current sampling image, an object is recognized in the current sampling image, or other such changes identified between the current sampling image and the baseline sampling image. Once a difference is determined between the baseline sampling image and the current sampling image, the camera lighting source 310 may be activated and the camera 300 may capture a detection image that may be processed by the optical recognition system 250 as discussed in more detail below to identify whether an authorized product has been inserted in the input cavity 260.

The baseline sampling image may be established after the merchandiser 170 has been installed at a location where it will be used. The merchandiser 170 may be operated in a programming mode by a technician installing the merchandiser 170 to trigger the camera 300 to capture and store the baseline sampling image at the location of use of the merchandiser 170. Accordingly, the baseline sampling image may take into account the ambient lighting conditions of the merchandiser 170 where it is used. Alternatively or in addition to the above, the merchandiser 170 may operate to periodically capture and store a new baseline sampling image during an idle period of the merchandiser 170 or otherwise when the merchandiser 170 is not actively being used. For example, a new baseline sampling image could be captured ever hour, every other hour, or at some other periodic interval. Accordingly, the baseline sampling image may take into account changes in the ambient lighting condition of the merchandiser 170 that may occur throughout the day.

Upon a product 10 being inserted or otherwise received into the input cavity 260 when the dispensing lever 210 is pushed forward, the product 10 may block the background lighting source or otherwise cause the optical recognition system 250 to detect a change between a current sampling image and a baseline sampling image. As discussed above, this signals the camera 300 and the camera lighting source 310 to activate. If the camera 300 identifies the product 10 as an authorized product, the electromagnets 290 may release the shuttle 270 such that the product 10 drops into the temperature controlled compartment 230. If not, the product 10 may roll toward the reject port 220, remain in the input cavity 260, or otherwise be disposed of The camera 300 may identify the product 10 as compared to a threshold of a baseline product image and the like.

Similar to the baseline sampling image, the baseline product image may be established after the merchandiser 170 has been installed at a location where it will be used. The merchandiser 170 may be operated in a product programming mode by a technician installing the merchandiser 170 to activate the camera lighting source 310 and trigger the camera 300 to capture and store the baseline product image at the location of use of the merchandiser 170. Accordingly, the baseline product image may take into account the ambient lighting conditions of the merchandiser 170 where it is used. In some embodiments, the camera lighting source 310 may be sufficiently strong to diminish the effects of the ambient lighting conditions of the merchandiser 170 and/or sufficiently strong to diminish the effects of changes in the ambient lighting conditions of the merchandiser throughout the day.

For merchandisers with multiple brands, a separate baseline product image may be generated for each of the authorized brands carried by the merchandiser. In such multiple brand merchandisers, the product programming mode may further receive input from a user interface (not shown) indicating valid storage location(s) within the merchandiser for each product brand. Other components and other configurations may be used herein.

Figure 8:
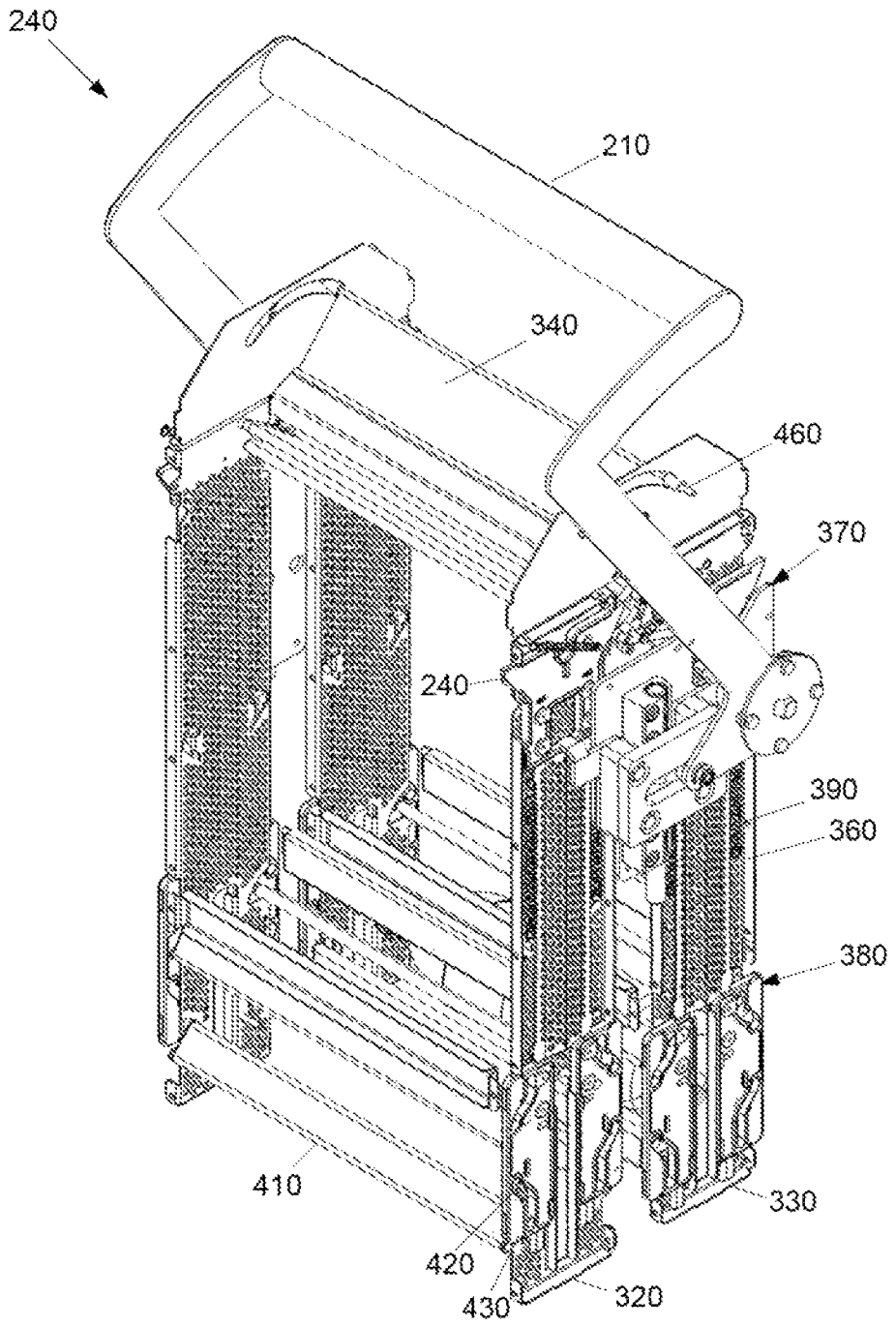
FIG. 8 is a perspective view of a dual chute product dispensing mechanism that may be used with the merchandiser of FIG. 3.
Figure 9:
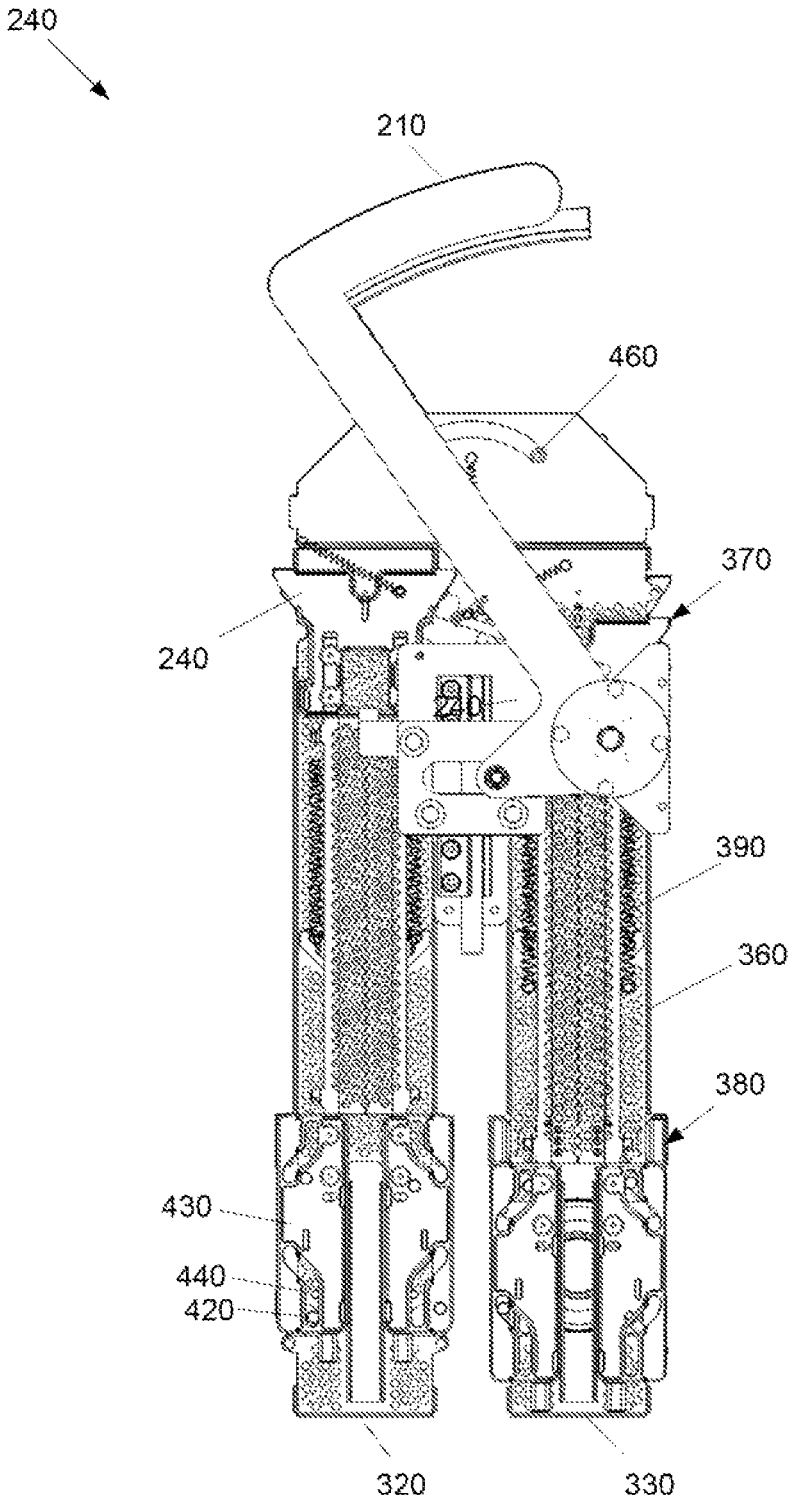
FIG. 9 is a side plan view of the dual chute product dispensing mechanism of FIG. 8.
Figure 10:
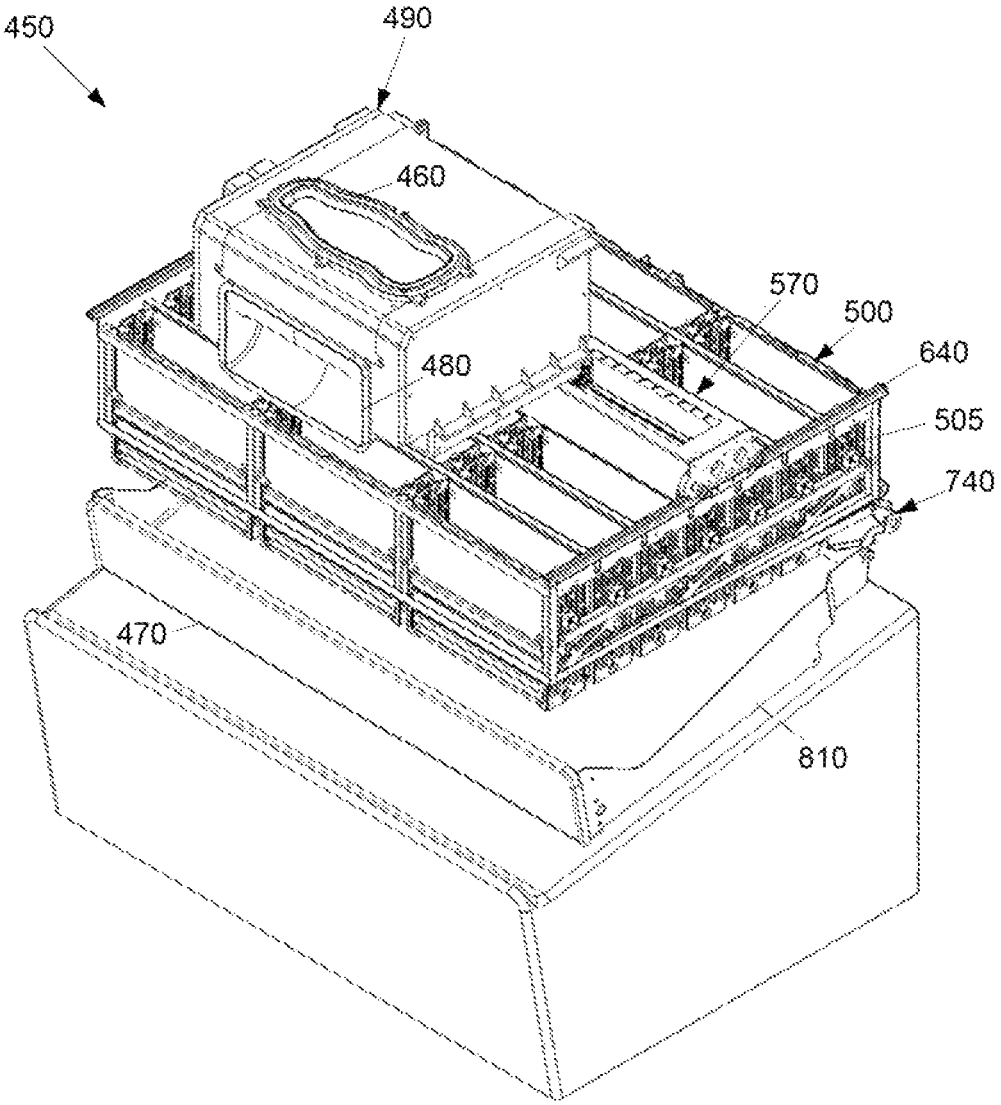
FIG. 10 is a perspective view of a further embodiment of a merchandiser as may be described herein.
Figure 11:
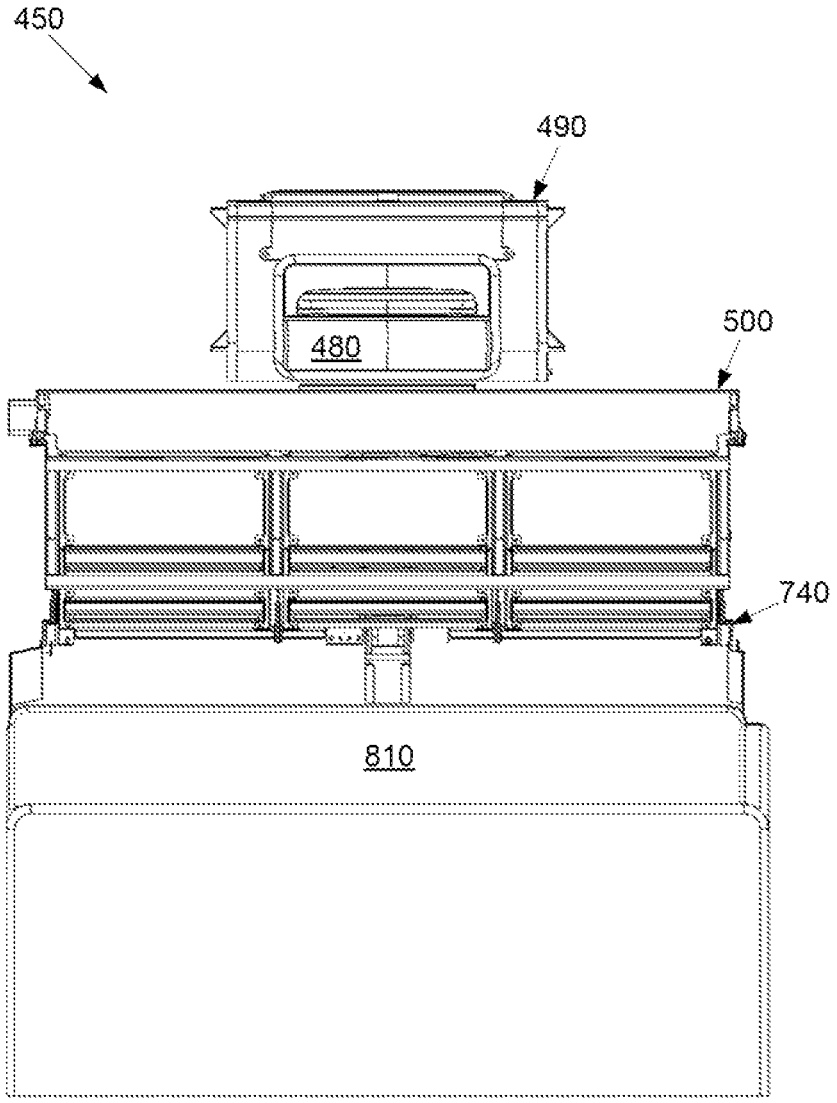
FIG. 11 is a front plan view of the merchandiser of FIG. 10.
Figure 12:
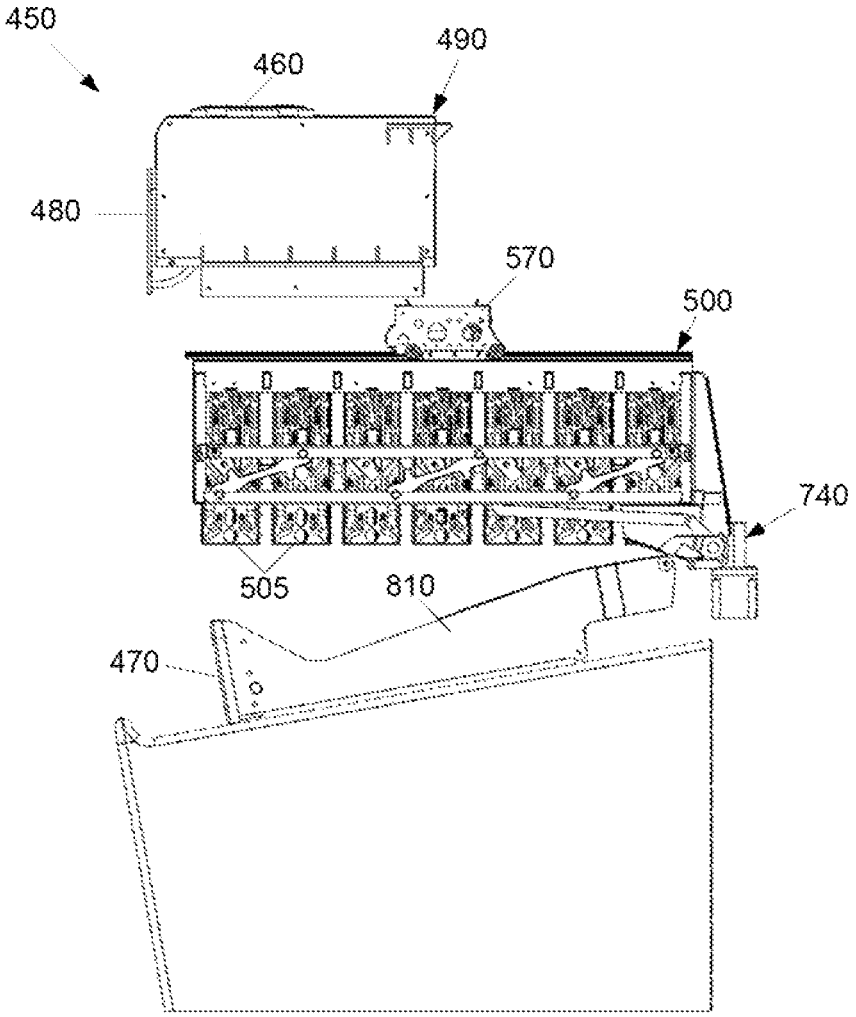
FIG. 12 is a side plan view of the merchandiser of FIG. 10.
Figure 13:
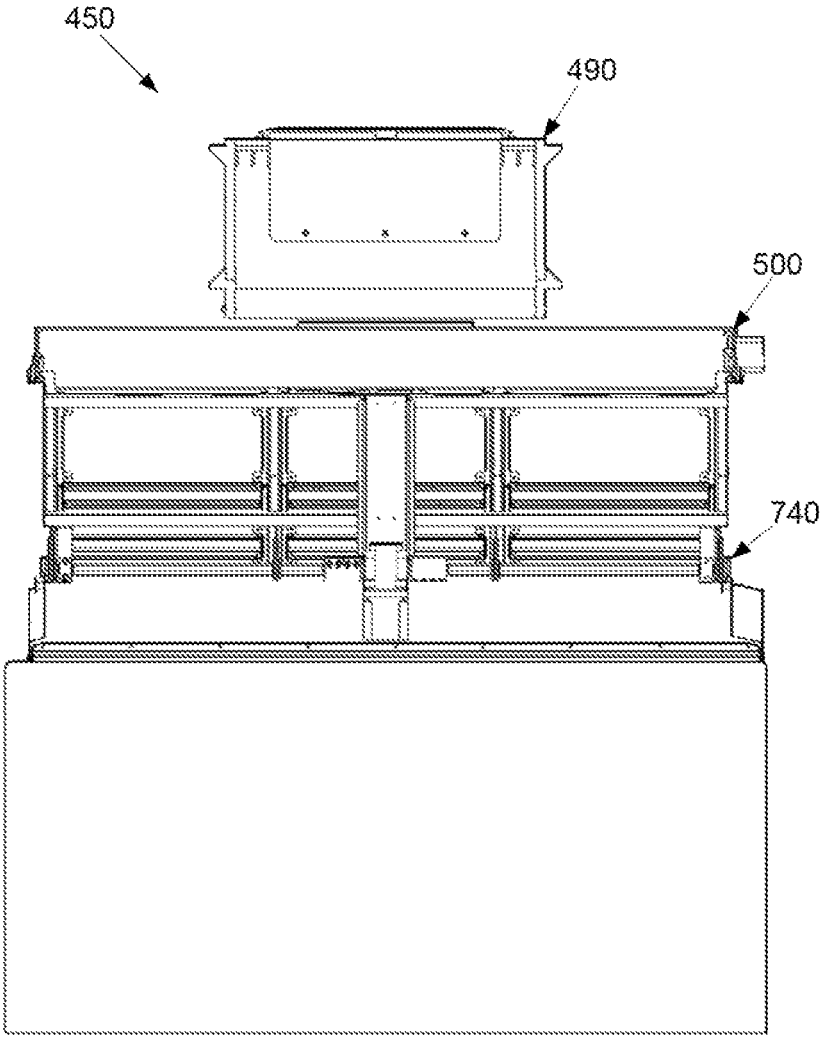
FIG. 13 is a rear plan view of the merchandiser of FIG. 10.
Figure 14:
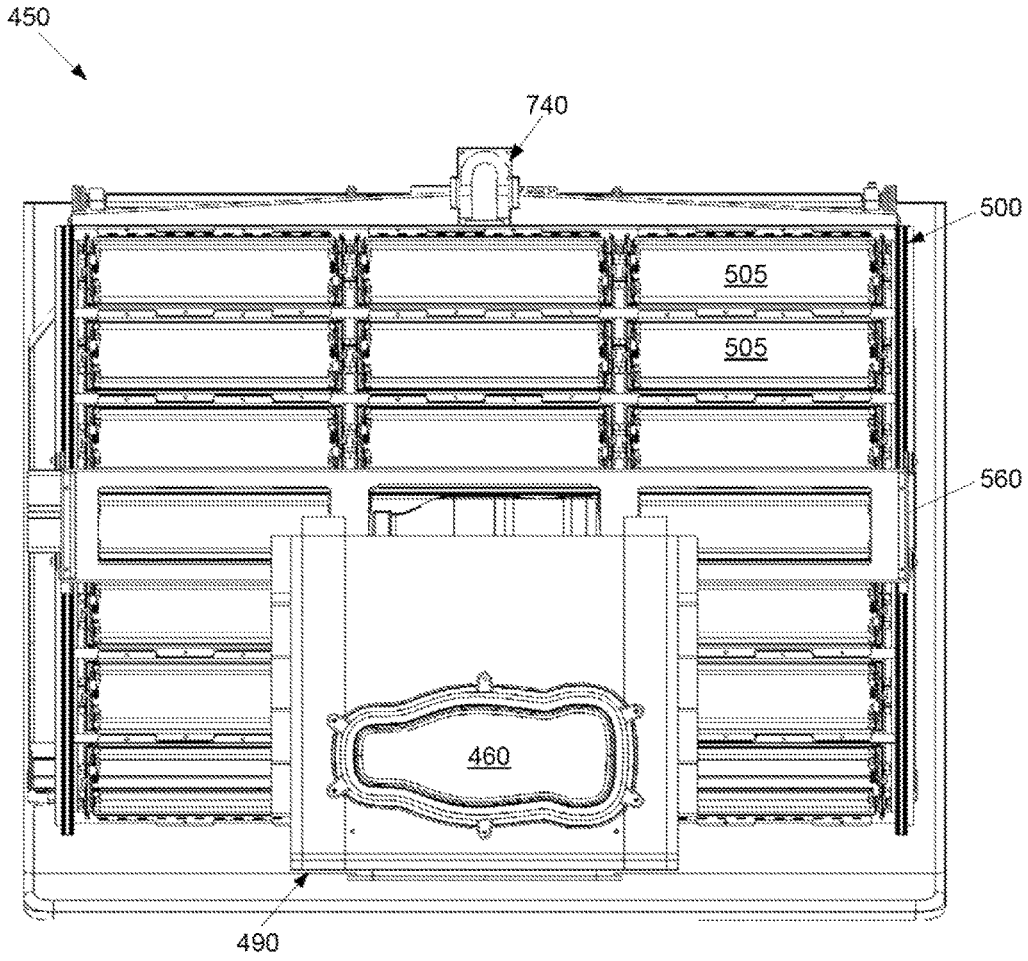
FIG. 14 is a top plan view the merchandiser of FIG. 10.

As is shown in FIGS. 8 and 9, the dual chute product dispensing mechanism 240 may include two product dispensing chutes 140 substantially as described above positioned within the temperature controlled compartment 230. In this example, a first product chute mechanism 320 and a second product chute mechanism 330 are shown in the dual chute product dispensing mechanism 240. The product chute mechanisms 320, 330 may share the dispensing lever 210. In this example, the dual chute product dispensing mechanism 240 also includes a product direction plate 340 maneuverable by a spring loaded direction plate rod 350. The product direction plate 340 may permit an incoming product 10 to drop into the first product chute mechanism 320 and the next product 10 to drop into the second product chute mechanism 330 so as to deliver the products 10 to each product chute mechanism 320, 330 in an alternating fashion. Other components and other configurations may be used herein.

The dual chute product dispensing mechanism 240 may be sized to include any number of products 10 therein in a vertically stacked orientation or otherwise. Each chute in the dual chute product dispensing mechanism 240 may include a pair of chute walls 360. The chute walls 360 may be made out of any type of substantially rigid material. Other types of separation or structural elements may be used herein so as to maintain the products 10 in a substantially horizontal orientation.

Each chute may be a mechanical dispensing mechanism with an upper loading mechanism 370 and a lower separation mechanism 380. The upper loading mechanism 370 may be in communication with the lower separation mechanism 380 via a spring loaded tow bar 390. The upper loading mechanism 370 may include an upper guide plate 240 attached to the spring loaded tow bar 390. Other mechanisms for translating the pivoting motion of the pivoting lever 210 to the vertical motion of the upper guide plate 400 may be used herein. Other components and other configurations may be used herein.

The lower separation mechanism 380 may include any number of stopper plates 410. The stopper plates 410 may have any suitable size, shape, or configuration. The stopper plates 410 may be continuous or intermittent along their length. The stopper plates 410 may be equipped with rollers and the like to accommodate easy rotation. Such rollers may be advantageous if the stack height increases the force on the plates 410. The stopper plates 410 may each have stopper plate rod 420 thereon. The ends of the stopper plate rods 420 may be captured by a lower guide plate 430 for movement therewith. The lower guide plate 430 may be in communication with the spring loaded tow bar 390. The lower guide plates 430 may have a number of stopper plate rod slots 440. The stopper plate rod slots 440 may guide the stopper plates 410 and the stopper plate rods 420 in an inward orientation and an outward orientation as the lower guide plate 430 maneuvers vertically with the spring loaded tow bar 390. Other components and other configurations may be used herein.

In use, a consumer pulls the dispensing lever 210 of the merchandiser 170, places an ambient product 20 within the input port 190, and releases or otherwise reruns the dispensing lever 210. The pivoting of the dispensing lever 210 alternatingly maneuvers the product direction plate 340 towards the first product chute mechanism 320 or the second product chute mechanism 330. Pushing the dispensing lever 210 thus pulls the tow bar 390 upward so as to cause the product in the lower position of the stack to be separated between the stopper plates 410. If there is no product entered in the top of the stack, the tow bar 210 will not move upward such that the product at the bottom of the stack will not be separated. The upper stopper plates 410 of the lower separation mechanism 380 may be in an inward orientation with a bottom temperature controlled product 30 supported thereon. As the upper guide plate 400 rises, the spring loaded tow bar 390 also pulls the lower guide plate 430 upward. This motion causes the lower stopper plates 410 to move into the inward orientation and the upper stopper plates into an outward orientation. The bottom temperature controlled product 30 thus drops from the upper stopper plates 410 towards the lower stopper plates in a bottom column position. Releasing or otherwise returning the lever 210 causes the spring loaded tow bar 390 to raise the lower guide plate 430. The upper stopper plates 410 thus maneuver into the inward orientation to capture the next temperature controlled product 30 while the lower stopper plates 410 move into the outward orientation so as to cause the bottom temperature controlled product 30 to be dispensed from the bottom column position. The dual chute product dispensing mechanism 240 thus mechanically dispenses the product 30 in an efficient manner without the use of electronics or motors. Other components and other configurations may be used herein.

FIGS. 10-14 show a further example of a merchandiser 450 as may be described herein. The merchandiser 450 may include the outer shell 180. The outer shell 180 may be made out of any substantially rigid material and may have any suitable size, shape, or configuration. The outer shell 180 may be insulated in whole or in part. The merchandiser 450 may include an input port 460, one or more dispensing ports 470, and a reject port 480. The ports 460, 470, 480 may have any suitable size, shape, or configuration. The merchandiser 450 may include a product input system 490 positioned about the outer shell 180. Other components and other configurations may be used herein.

The merchandiser 450 may include the temperature controlled compartment 130. The temperature controlled compartment 130 may have any suitable size, shape, or configuration. The merchandiser 450 may include a multi-chute product dispensing mechanism 500. The multi-chute product dispensing mechanism 500 may positioned within the temperature controlled compartment 130 and may use any number of the product dispensing chutes 505 or similar types of dispensing mechanisms to dispense a product therefrom. Although nine (9) product dispensing chutes 505 are shown, any number may be used herein in any configuration. Each product chute 505 may have a specific type or brand of products 10 therein such that the merchandiser 450 may offer many different types or brands of products 10. Any number of types or brands of products 10 may be used herein. Differently sized product chutes 505 may be used for differently sized products. Products 10 of differing temperatures also may be used herein.

Figure 15:
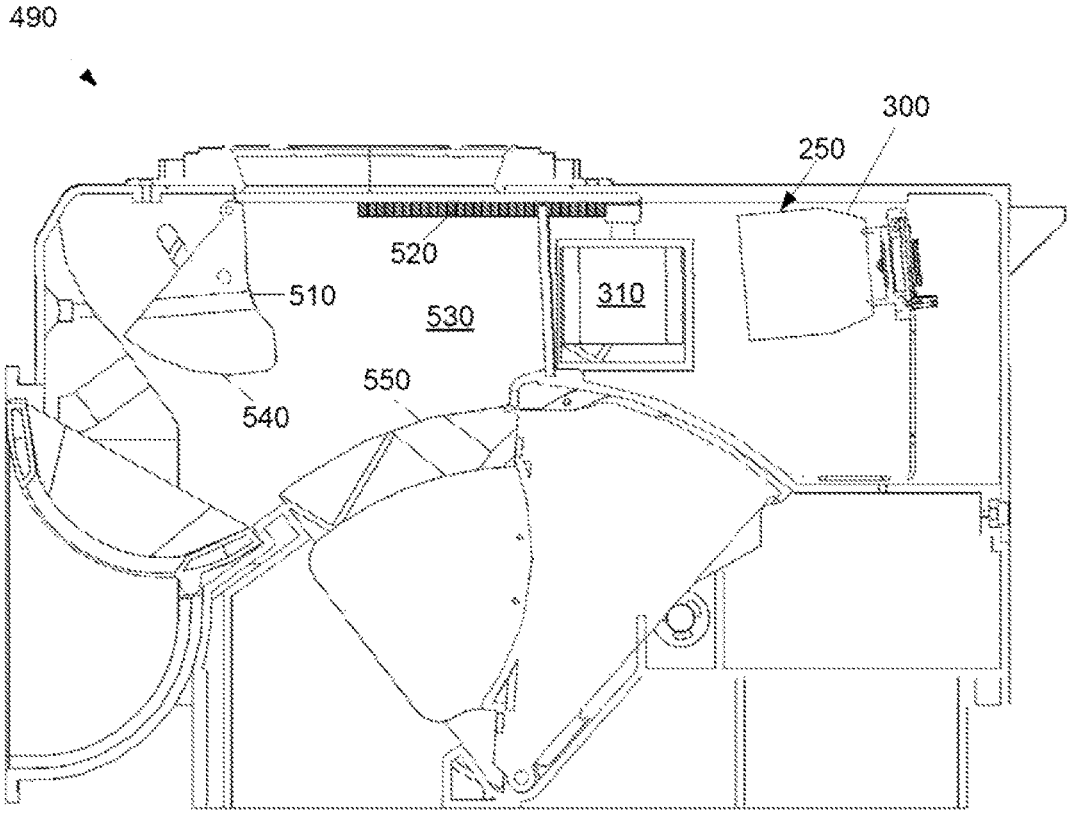
FIG. 15 is a perspective view of an optical recognition system that may be used with the merchandiser of FIG. 10.

FIG. 15 shows a sectional view of the product input system 490. The product input system 490 may include the input port 460 and the reject port 480. The product input system 490 may include an identification module 160 in the form of the optical recognition device 250. Specifically, the optical recognition device 250 may include the camera 300, the main light 310, as well as a background light 510. The optical recognition device 250 may operate in a substantially similar manner as that described above.

The product input system 490 may include a shutter 520 positioned about the input port 460. The shutter 520 may open and shut so as to allow access to an input cavity 530 via the input port 460. The product input system 490 also may include a reject selector 540 and an input selector 550. The reject selector 540 may be a pivoting device positioned about the reject port 480. Likewise, the input selector 550 may be a pivoting device positioned about the temperature controlled compartment 130.

In use, the shutter 520 may be opened so as to allow access to the input cavity 530 of the product input system 490. Unauthorized small objects may fall directly into the reject port 480. A product 10 may be positioned within the input port 460 and fall into the input cavity 530. The product 10 will block the background light 510 so as to activate the camera 300 and the main light 310. The camera 300 may then attempt to recognize the product 10. If the product 10 is not recognized or not authorized, the reject selector 540 may pivot so as to allow the product 10 to roll into the reject port 480 and/or the product is otherwise disposed of If the product 10 is recognized and authorized, the input selector 550 may pivot so as to allow the product 10 to drop into the temperature controlled compartment 130. Likewise, the shutter 520 will close so as to block entry into the temperature controlled compartment 130 as well as the loss of the cool air therein. Manual input systems also may be used herein. Other components and other configurations may be used herein.

Figure 16:
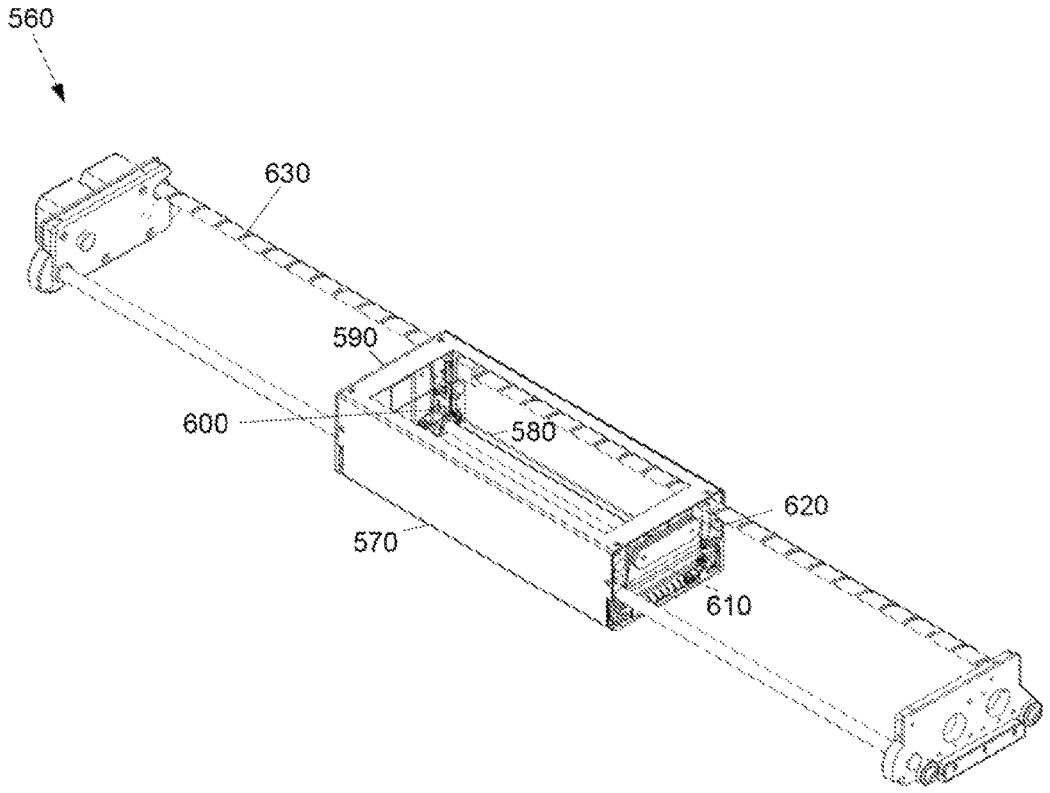
FIG. 16 is a perspective view of an X-Y drive device that may be used with the merchandiser of FIG. 10.

The merchandiser 450 may include an X-Y drive device 560 cooperating with the multi-chute product dispensing system 500. The X-Y drive device 560 may deliver a product 10 from the product input system 490 to any one of the product dispensing chutes 505. As is shown in FIG. 16, the X-Y drive device 560 may include a product carriage 570. The product carriage 570 may have a number of product support bars 580 therein. The product support bars 580 may extend along the length of the product carriage 570 and beyond the lateral walls 590 of the product carriage 570. The product support bars 580 may be movable within a number of support bar slots 600. The support bar slots 600 may have a substantial "J" shape such that the support bars 580 may be maneuvered so as to allow a product 10 to fall therethrough. Each of the walls 590 also may have a locking plate 610 thereon. The locking plate 610 may have a number of locking plate slots 620. The locking plate slots 620 may accommodate the product support bars 580 so as to pivot the product support bars 580 open and closed.

The X-Y drive device 560 may include a number of X drive rods 630. The X drive rods 630 may extend along a first dimension of the multi-chute dispensing system 500. The product carriage 570 may maneuver along the X drive rods 630 in the X direction. The X-Y drive device 560 also may include a number of Y drive rods 640. The Y drive rods 640 may extend along a second dimension of the multi-chute product dispensing system 500. The product carriage 570 and the X drive rods 630 may maneuver in the Y direction along the Y drive bars 640. The X-Y drive device 560 may be of conventional design. The X drive rods 630 and the Y drive rods 640 may be motor driven. Other components and other configurations may be used herein.

Figure 17:
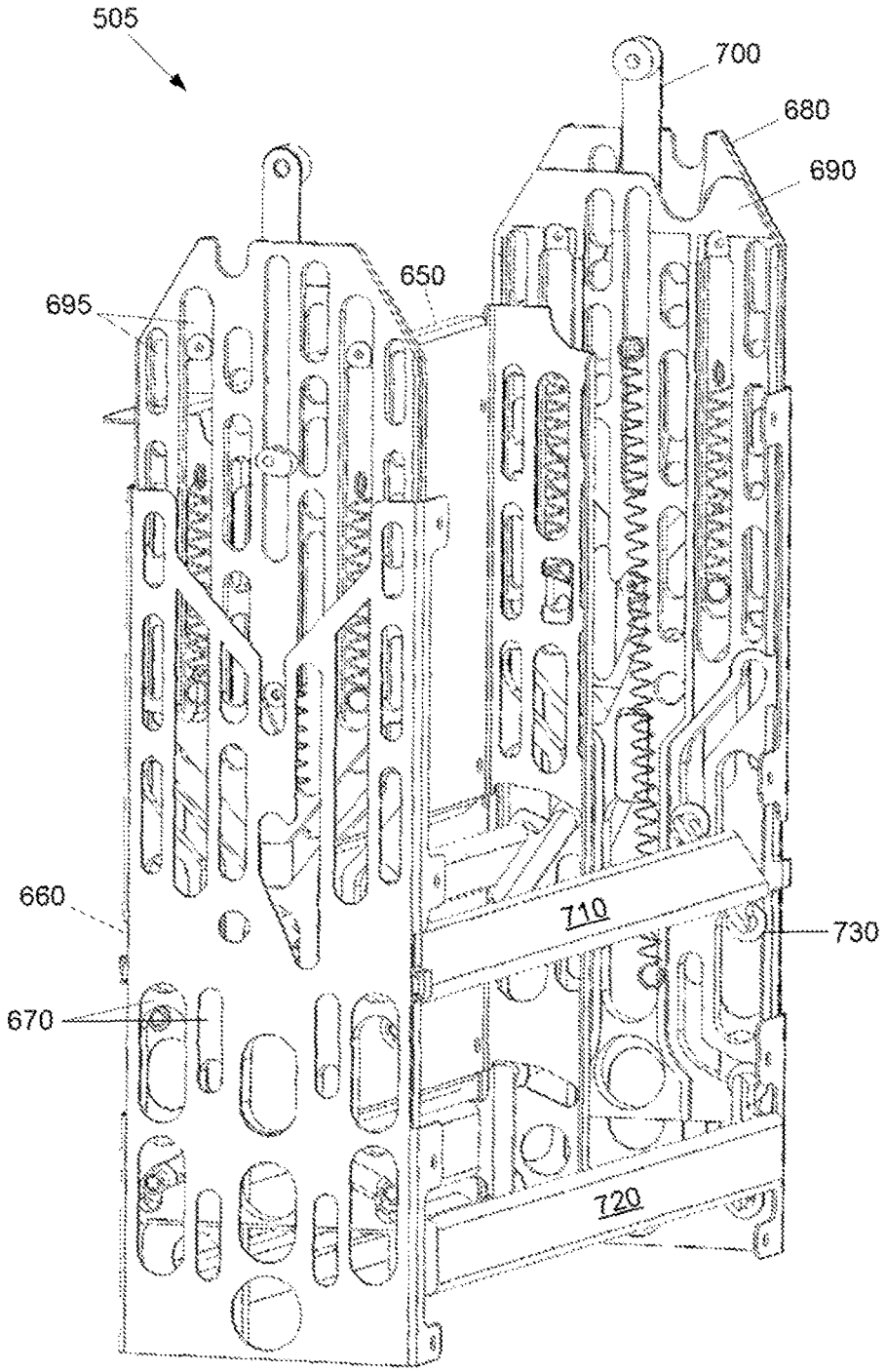
FIG. 17 is a perspective view of a product dispensing chute that may be used with the merchandiser of FIG. 10.

FIG. 17 shows an example of one of the product dispensing chutes 505. The product dispensing chute 505 is shown in an extended, dispensing position. The product dispensing chute 505 may have a pair of lateral walls 650, one of which is removed in FIG. 17 for clarity. Each product dispensing chute 505 also may include a pair of dispensing walls 660. The dispensing wall 660 may have any number of dispensing wall apertures 670 therein. The dispensing wall apertures 670 may be sized and positioned so as to accommodate the various rollers and rods described below. Each of the dispensing walls 660 may have an upper guide plate 680 and a lower guide plate 690 positioned for movement therein. The guide plates 680, 690 may spring loaded. An activation lever 700 may extend between the guide plates 680, 690 for movement therewith. The activation lever 700 also may be spring loaded. A pair of upper stopper plates 710 and a pair of lower stopper plates 720 may be positioned about the lower guide plate 690. The stopper plates 710, 720 may have a number of roller bearings 730 and the like positioned within the guide plate apertures 695 for movement therewith. Other components and other configurations may be used herein.

Figure 18:
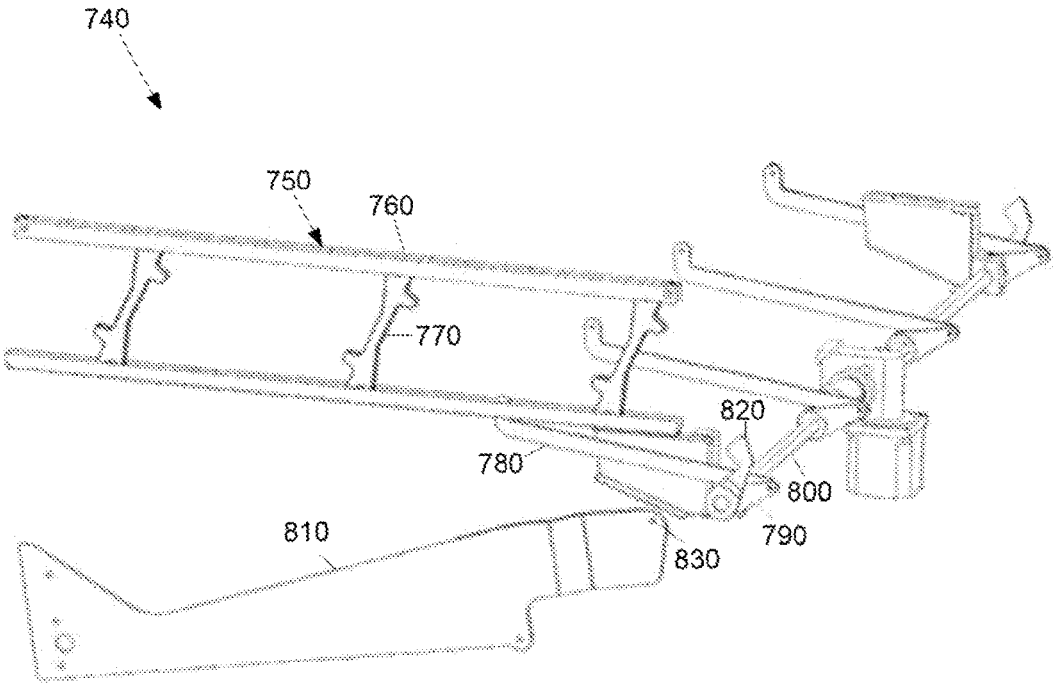
FIG. 18 is a perspective view of a product dispense activation mechanism that may be used with the merchandiser of FIG. 10.
Figure 19:
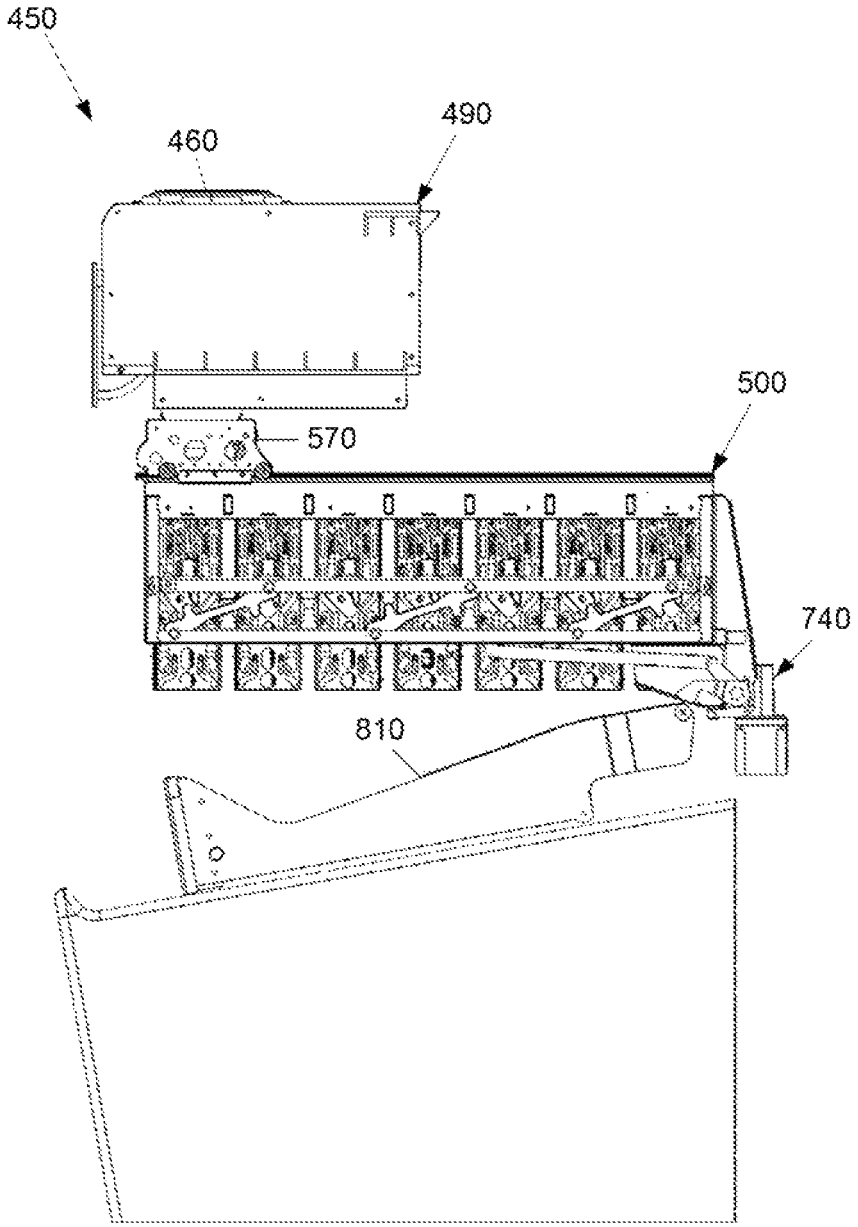
FIG. 19 is a side plan view of a multi-chute product dispensing mechanism of the merchandiser of FIG. 10 in use.

The multi-chute product dispensing system 500 also may include a dispense activation mechanism 740. As is shown in FIG. 18, the dispense activation system 740 may include a number of chute drive rails 750. An upper chute drive rail 760 may maneuver up and down via a number of drive levers 770. The upper chute drive rails 760 and the drive levers 770 may be maneuvered by a push rod 780. In turn, the push rod 780 may be maneuver by a drive gear 790 and a drive rod 800. The drive rod 800 may be motor driven. The rotation of the drive rod 800 may create linear motion for the push rod 780 via the drive gear 790 such that the upper chute drive rails 760 may interact with the product dispensing chutes 505. Other components and other configurations may be used herein.

The dispense activation mechanism 740 also may raise and lower a dispensing shutter 810. The dispensing shutter 810 may open and close the dispensing port 470. A shutter lever 820 may pivot the dispensing shutter 810 about a shutter pivot 830. The shutter lever 820 may be driven by the drive rod 800 for open and shut motion. Other components and other configurations may be used herein.

Figure 20:
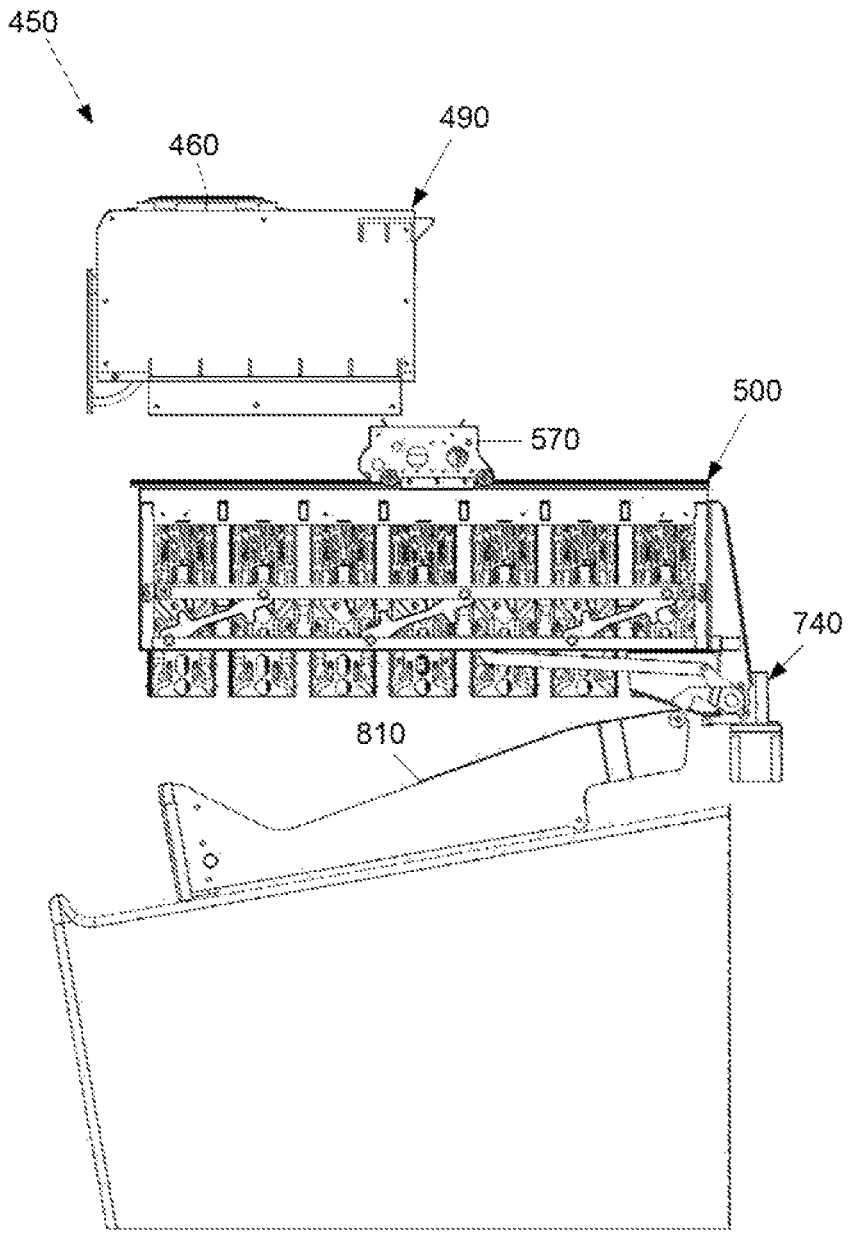
FIG. 20 is a side plan view of the multi-chute product dispensing mechanism of the merchandiser of FIG. 10 in use.

FIGS. 19-22 show the operation of the merchandiser 450. An ambient product 20 may be positioned within the input port 460 of the product input system 490. The product 20 may be identified via the optical recognition device 250 or other type of identification module 160. If the product 20 is not recognized or not authorized, the reject selector 540 may pivot such that the product 20 rolls to the reject port 480. If the product 20 is recognized and authorized, the input selector 550 may pivot such that the product 20 may drop into the product carriage of the X-Y drive device 560 in the multi-chute product dispense system 500. The X-Y drive device 560 may maneuver the product carriage 570 to the appropriate product chute 505. Specifically, once the product 20 has been identified the X-Y drive device 560 will position the product carriage 570 over the appropriate product chute 505. For example, if the product 20 is identified as soda brand A, the X-Y drive device 560 will deliver the product carriage 570 to the product chute 505 with a number of chilled brand A products 30 therein. The product carriage 570 thus may be maneuvered over the appropriate product chute 505 as is shown in FIG. 20. Positioning the product carriage 570 over the product chute 505 also causes the product carriage 570 to engage the activation lever 700 of the given product chute 505.

Figure 21:
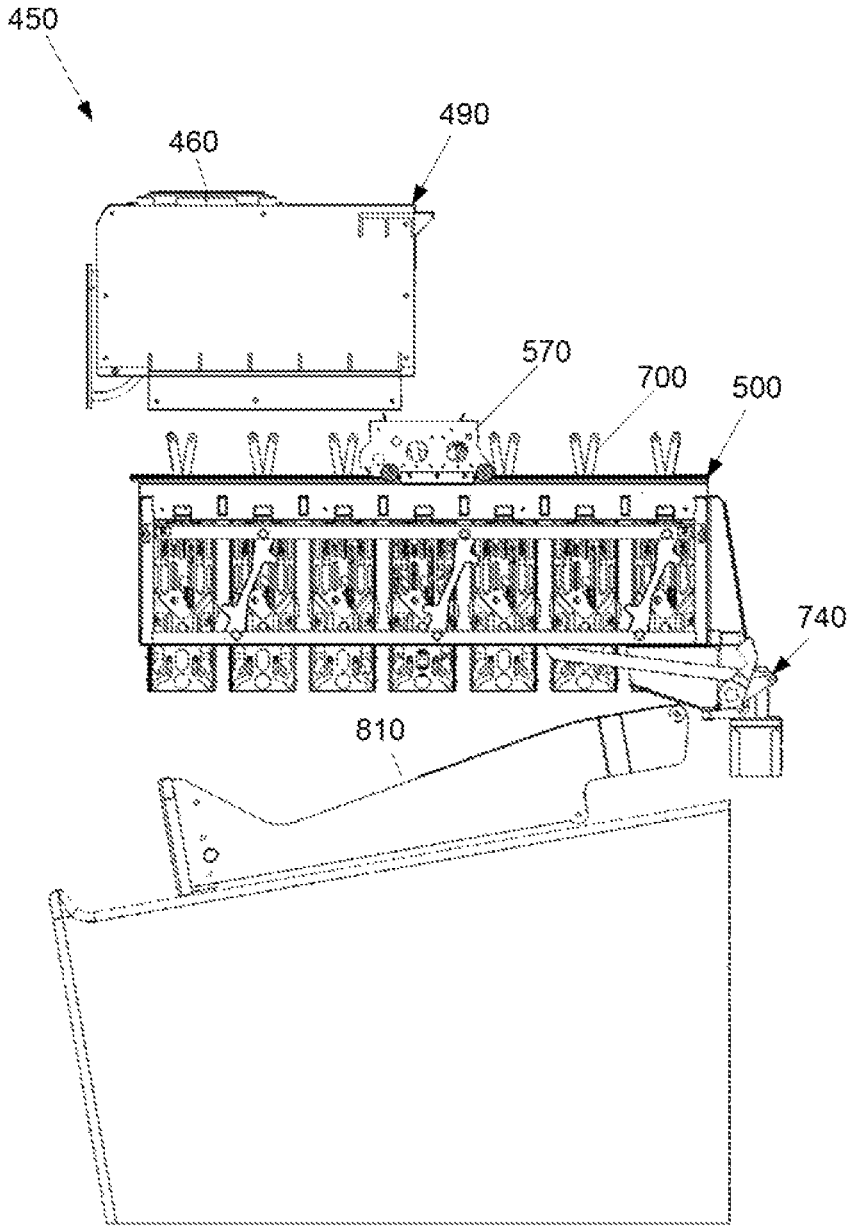
FIG. 21 is a side plan view of the multi-chute product dispensing mechanism of the merchandiser of FIG. 10 in use.
Figure 22:
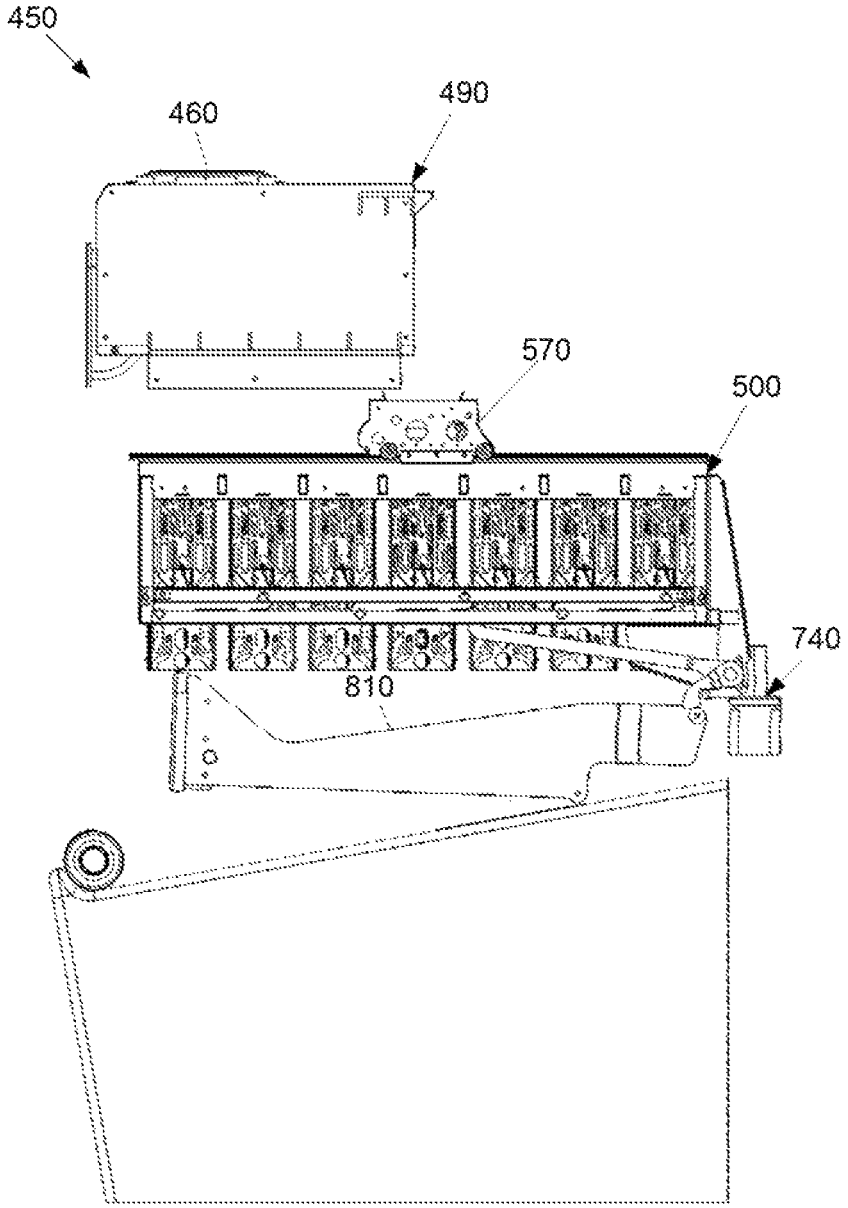
FIG. 22 is a side plan view of the multi-chute product dispensing mechanism of the merchandiser of FIG. 10 in use.
Figure 23:
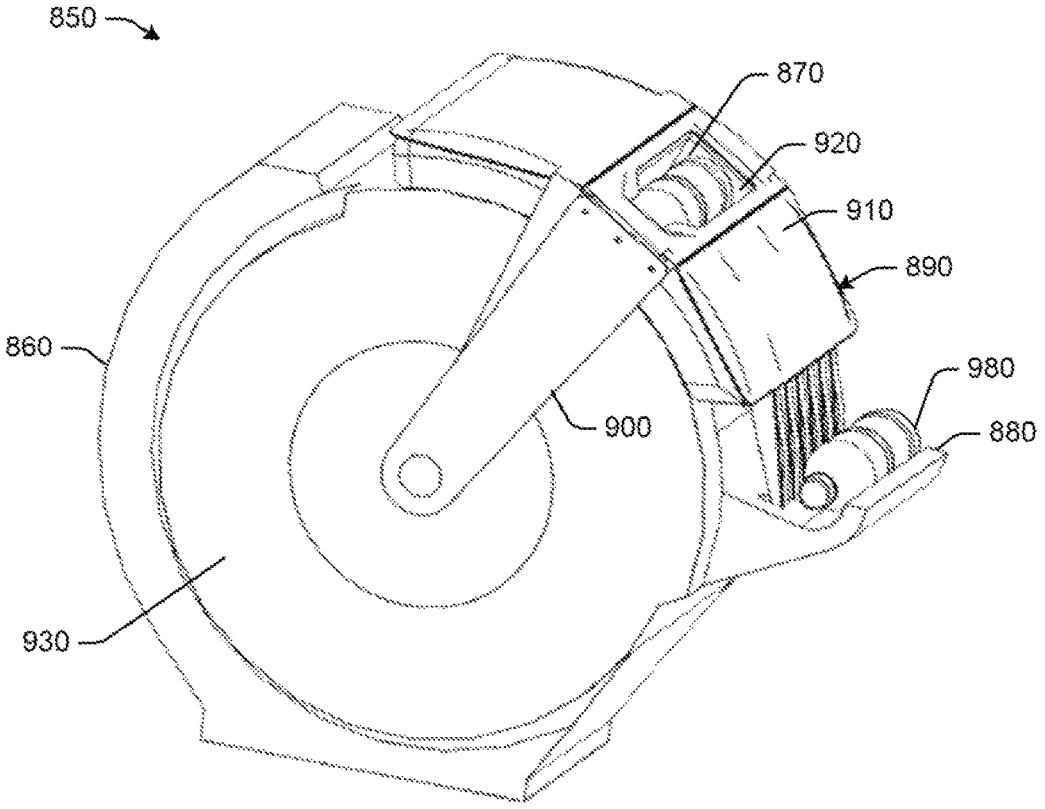
FIG. 23 is a perspective view of a super-chill merchandiser as may be described herein.
Figure 24:
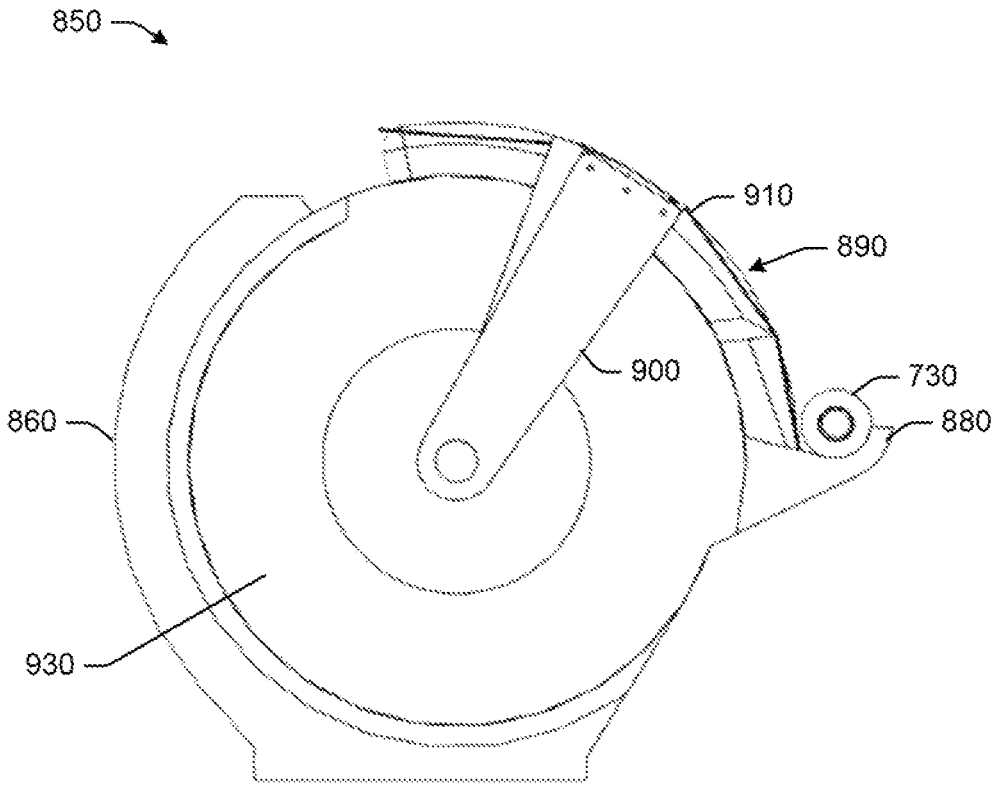
FIG. 24 is a side plan view of the super-chill merchandiser of FIG. 23.
Figure 25:
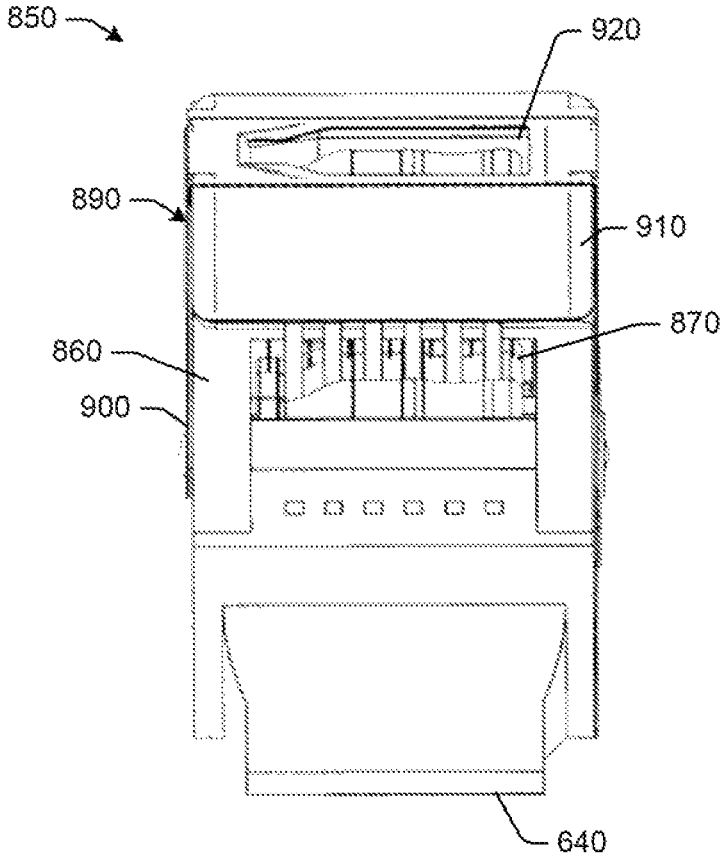
FIG. 25 is a front plan view of the super-chill merchandiser of FIG. 23.
Figure 26:
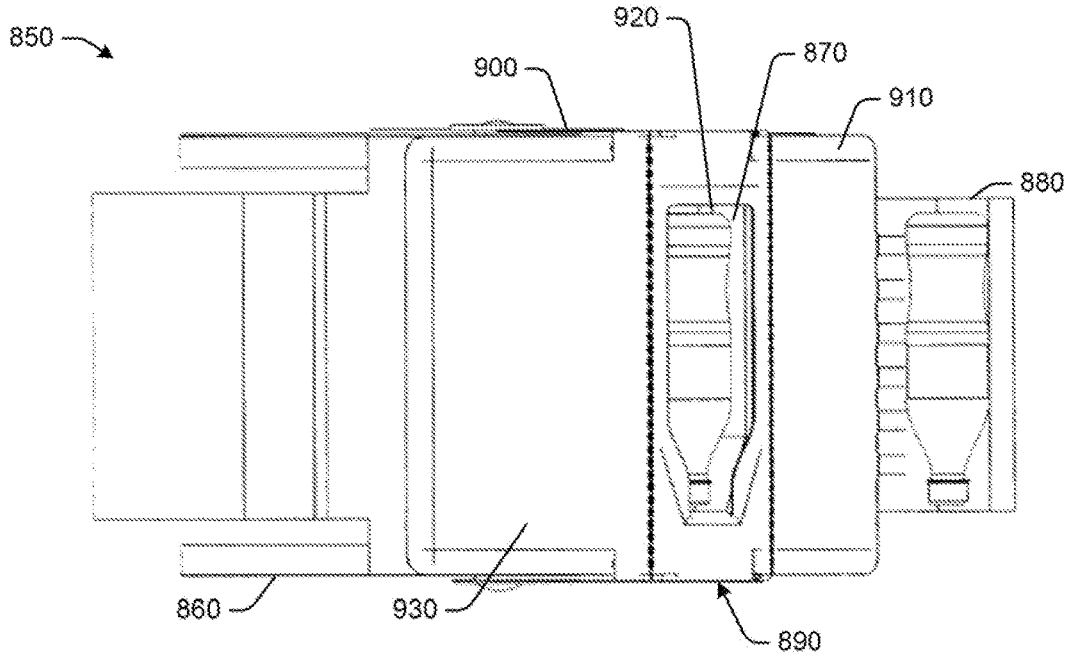
FIG. 26 is a top plan view of the super-chill merchandiser of FIG. 23.

As is shown in FIG. 21, the dispense activation mechanism 740 maneuvers the upper chute drive rail 760 so as to push upward the activation lever 700 of the product chute 505. Raising the activation lever 700 also raises the upper guide plate 680. The lower stopper plates 720 begin in an engaged position to support a product therein while the upper stopper plates 710 are open. As the upper guide plate 680 rises, the plate 680 engages the locking plate 610 and the product support bars 580 of the product carriage 570 and pushes them outwardly so as to permit the product therein to drop into the product chute 505. Further motion of the upper chute drive rail 760 begins to pull the lower guide plate 690 such that upper stopper plates 710 close and then the lower stopper plates 720 open such that a temperature controlled product 30 falls out of the product chute 505. Further rotation of the drive rod 800 also rotates the shutter lever 820 such that the dispensing shutter 810 opens and the product 30 rolls into the dispensing port 470. Other components and other configurations may be used herein.

As compared to the typical power usage of about 115 Watt hours per liter of cooled beverage, the merchandiser 450 described herein may consume only about 67 Watt hours per liter of cooled beverage. The overall energy usage may vary. Although the merchandiser 450 has been described in the context of a chilled beverage, warm or hot beverages and other products also may be used herein. Moreover, an ambient-for-hot merchandiser also comes with product quality and extended shelf life benefits. Many hot equipment solutions with a large stock of hot products generally require dispensing before a given best-consumed-before-date. Inside an oven, product quality may deteriorate quickly such that consumption of the hot beverage would need to take place within just a couple of days of loading or restocking. With the merchandiser herein, only a limited number of products may be kept hot for a shorter period of time. This offers both energy saving benefits and product quality benefits.

Similarly, the merchandiser 450 also may have both a cold compartment and a hot compartment. In such an embodiment, the compartments may share an input port 460 and an X-Y drive 560 device or each compartment may have a separate input port 460 and a separate X-Y drive device 560. The size, shape, configuration, and temperature of these compartments may vary. Alternative compartments also include the super-chill embodiments described below.

FIGS. 23-28 show an example of a super-chill merchandiser 850 as may be described herein. The super-chill merchandiser may include an outer shell 860. The outer shell 860 may be made from any type of substantially rigid material and may have any suitable size, shape, or configuration. The outer shell 860 may be insulated in whole or in part. The super-chill merchandiser 850 may include an input port 8700 and a dispensing port 880. The super-chill merchandiser 850 may include a dispensing lever 890 positioned about the outer shell 860. The dispensing lever 890 may include a pair of input port arms 900 for maneuvering an input port plate 910 along the outer shell 860. The input port plate 910 also may include an input port plate aperture 920 therein. The input port plate 910 moves along the outer shell 860 until the input port plate aperture 920 aligns with the input port 870.

In some embodiments, the merchandiser 850 may only house a single brand of products 10. In such embodiments, the input port plate aperture 920 may be sized and shaped to correspond to the silhouette of the packaging of the single brand. Therefore, only products 10 with the silhouette of the packaging of the single brand may be inserted into the merchandiser 850. In some embodiments, the merchandiser 850 may include the identification module 160 for ensuring that an ambient product 20 of the appropriate brand is inserted into the merchandiser 850. The identification module 160 may interact with a locking mechanism (not shown) that prevents activating the dispensing lever 890 unless the appropriate brand of product has been identified. Other components and other configurations may be used herein.

The super-chill merchandiser 850 includes a temperature controlled compartment 930. A conventional refrigeration system may be used herein. The temperature controlled compartment 930 may chill a product from a conventional chilled temperature of about four degrees Celsius or so by an additional six to eight degrees so as to deliver a "super-chilled" product at about negative four degrees Celsius or so. Alternatively, the temperature controlled compartment 930 may chill a product from ambient temperatures to about four degrees Celsius. Other temperatures may be used herein.

Figure 27:
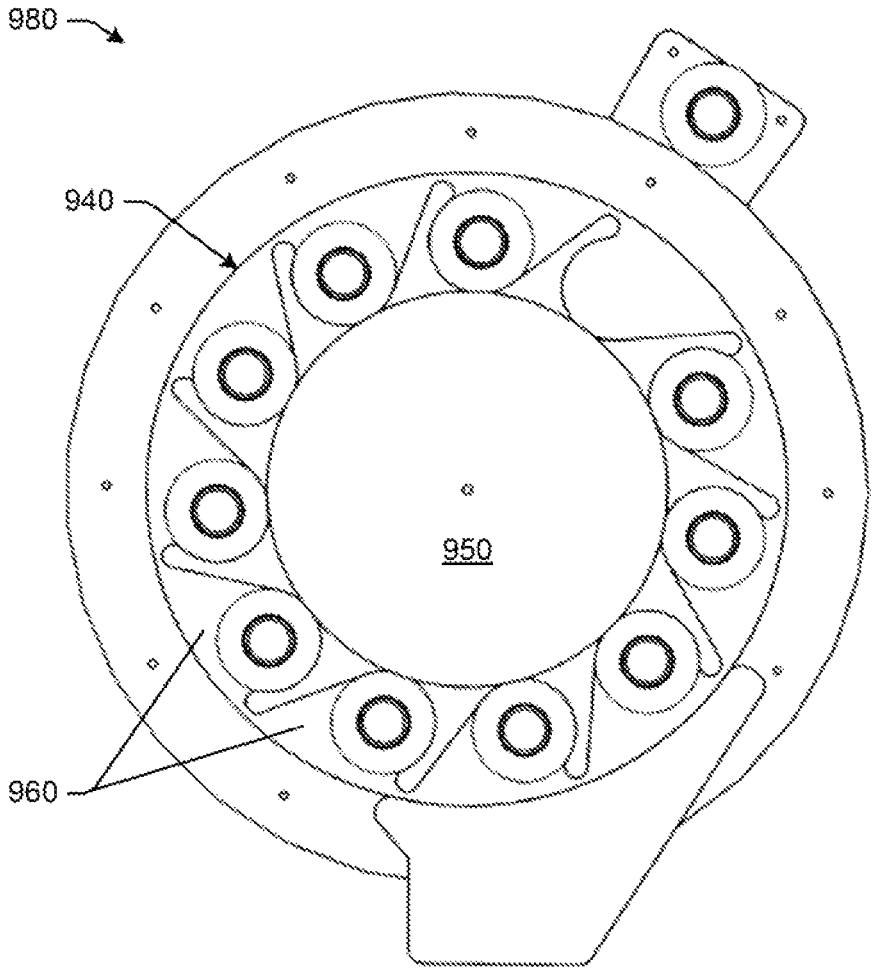
FIG. 27 is a partial side plan view of a dispensing mechanism for use with the super-chill merchandiser of FIG. 23.
Figure 28:
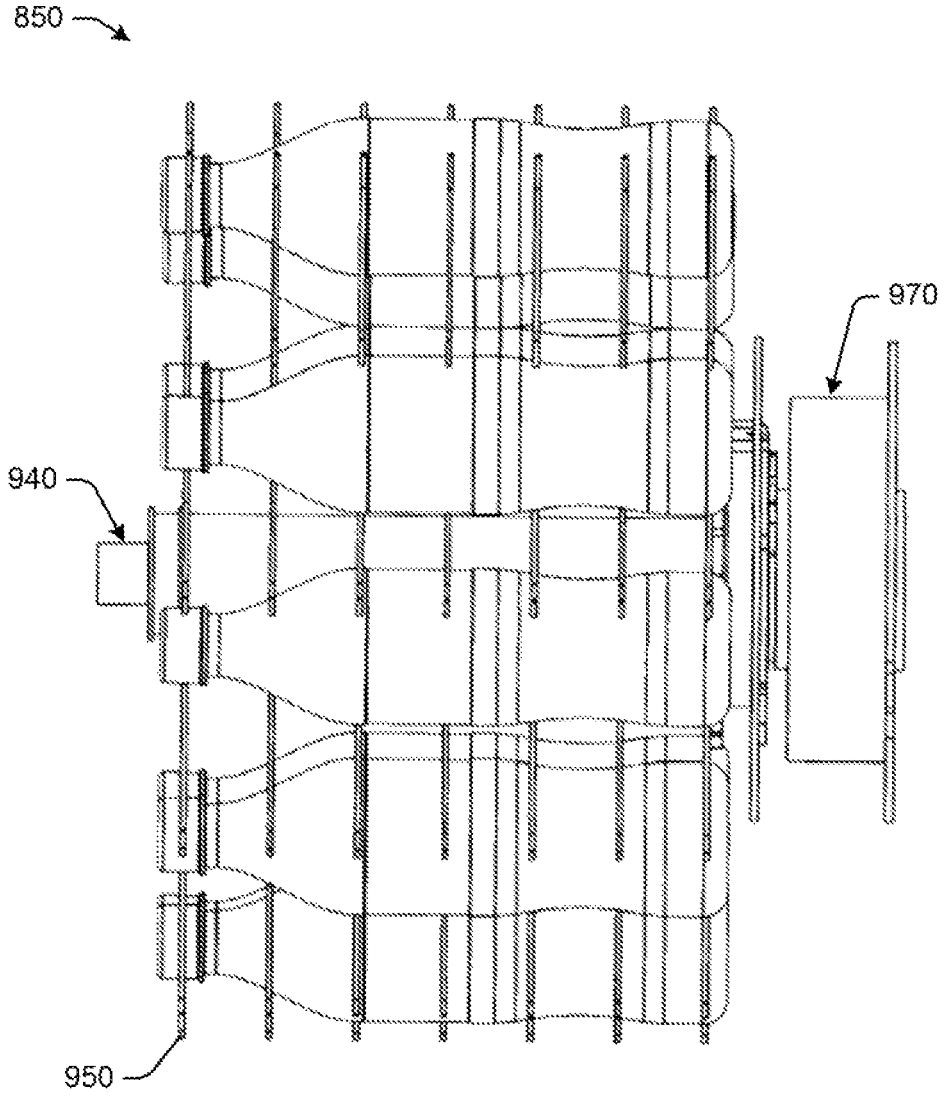
FIG. 28 is a further partial side plan view of the dispensing mechanism of FIG. 23.

As is shown in FIGS. 27 and 28, the super-chill merchandiser 850 may include a rotary dispensing mechanism 940 positioned within the temperature controlled compartment 930. The rotary dispensing mechanism 940 may include a dispensing wheel 950 with a number of product compartments 960 thereon. The dispensing wheel 950 may be made out of a number of spaced apart dispensing wheel plates, best shown in FIGS. 27 and 28. The spacing between each of the dispensing wheel plates promotes proper air flow through the temperature controlled compartment 930. Any number of the product compartments 960 may be used herein in any suitable size, shape, or configuration. The rotary dispensing mechanism 850 may include a ratchet mechanism 970. Rotation of the dispensing lever 890 may cause the ratchet mechanism 970 to advance the dispensing wheel 950 about the length of one product compartment 960 so as to dispense a product 10 via the dispensing port 880. Other types of advancement or rotation means and devices may be used herein. Other components and other configurations may be used herein.

In use, a consumer may maneuver the input port plate 910 of the dispensing lever 890 such that the input port plate aperture 920 aligns with the input port 870. The consumer may place an ambient product 20 or even a temperature controlled product 30 into the input port 870. The consumer then may maneuver the dispensing lever 890 such that the rotary dispensing mechanism 940 causes the dispensing wheel 950 to rotate about the distance of about one product compartment 960 via the ratchet mechanism 970. This rotation of the dispensing wheel 950 causes a super-chilled product 980 to exit via the dispensing port 880. The diameter of the dispensing wheel 950 and the usual dispensing volume may ensure that a product therein may reach the desired super-chilled temperature. Other components and other configurations may be used herein.

Figure 29:
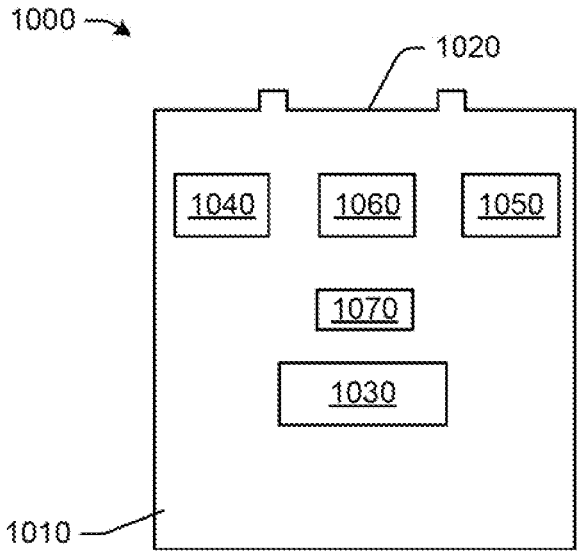
FIG. 29 is a schematic view of a further embodiment of a merchandiser as may be described herein.

FIG. 29 shows a further embodiment of a merchandiser 1000 as may be described herein. The merchandiser 1000 may include an outer shell 1010. The outer shell 1010 may be made out of any type of substantially rigid material and may have any suitable size, shape, or configuration. The outer shell 1010 may be insulated in whole or in part. The outer shell 1010 may include an input port 1020 and a dispensing port 1030. An identification module 160 and other components and other configurations may be used herein.

The merchandiser 1000 may include a controller 1040. The controller 1040 may be any type of programmable logic device with appropriate data storage mediums. More than one controller 1040 may be used herein. The controller 1040 may be positioned with in the merchandiser 1000 or remote therefrom. The overall operation of the merchandiser 1000 may be controlled by the controller 1040. The merchandiser 1000 also may include an input/output device 1050 in communication with the controller 1040. The input/output device 1050 may be a conventional video screen, touch screen, keypad, and the like. The input/output device 1050 may provide any type of messaging to the consumer as well as provide operational parameters for the merchandiser 1000 as a whole. The merchandiser 1000 may include a communications device 1060. The communications device 1060 may be of conventional design and may allow the merchandiser 1000 to communicate wirelessly or otherwise with consumers as well as transmit and receive operational data and other types of communications to and from the merchandiser operator or elsewhere.

Figure 30:
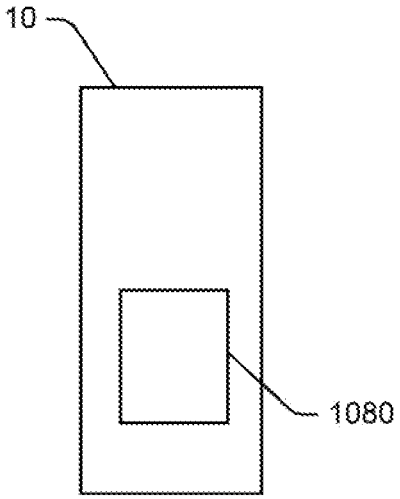
FIG. 30 is a schematic view of a product that may be used with the merchandiser of FIG. 29.

The merchandiser 100 also may include a printer 1070. The printer 1070 may be of conventional design. The printer 1070 may be positioned about the dispensing port 1030 or elsewhere. The printer 1070 may print directly onto the products 10 themselves or onto labels 1080 or other surfaces as desired. As is shown in FIG. 30, the printer 1070 may print a label 1080 for application to the product 10. Other components and other configurations may be used herein.

The communications device 1060 of the merchandiser 1010 may wirelessly receive data from, for example, a biosensor of a consumer. The controller 1040 then may suggest one type of product 10 to accommodate the received bio-data via the input/output device 1050. Other types of consumer input may be used herein. Specifically, non-physiological data also may be considered. For example, exertion data may be used so as to determine the appropriate product for the consumer. Moreover, the merchandiser 1000 may dispense other types of additives or ingredients intended for use with the product 10 depending upon the input. The merchandiser 1000 also may communicate with the consumer by, for example, sending a targeted text messages to the consumer's phone. Such messages may include coupons, sales offers, or other types of information. Similarly, the printer 1070 may print the label 1080 so as to personalize the product 10 with, for example, the consumer's name or other indicia. Other types of product personalization may be used herein. The merchandiser 1000 described herein thus may deliver a personalized experience to the consumer.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

The following numbered clauses set out further aspects of the invention (which may optionally be combined with other aspects) along with preferred and/or optional features thereof:

1. A merchandiser, comprising: a temperature controlled compartment; and a product dispensing chute mechanism positioned within the temperature controlled compartment; the product dispensing chute comprising an upper loading mechanism and a lower separation mechanism connected by a tow bar.

2. The merchandiser of clause 1, wherein the tow bar comprises a spring loaded tow bar.

3. The merchandiser of clause 2, wherein the upper loading mechanism comprises an upper guide plate in communication with the spring loaded tow bar.

4. The merchandiser of clause 3, wherein the upper loading mechanism comprises a pivoting lever in communication with the upper guide plate via an upper guide rod.

5. The merchandiser of clause 2, wherein the separation mechanism comprises a lower guide plate in communication with the spring loaded tow bar.

6. The merchandiser of clause 5, wherein the separation mechanism comprises a plurality of stopper plates in communication with the lower guide plate via a plurality of stopper plate rods.

7. The merchandiser of clause 6, wherein the plurality of stopper plates comprises a pair of upper stopper plates and a pair of lower stopper plates.

8. The merchandiser of clause 6, wherein the lower guide plate comprises a plurality of stopper plate guide slots in communication with the plurality of stopper plate rods.

9. The merchandiser of clause 1, further comprising a plurality of product dispensing chute mechanisms.

10. The merchandiser of clause 1, further comprising an ambient product compartment.

11. The merchandiser of clause 1, further comprising an identification module.

12. The merchandiser of clause 11, wherein the identification module comprises an optical recognition device.

13. The merchandiser of clause 1, further comprising a dispensing lever in communication with a pair of product dispensing chute mechanisms.

14. The merchandiser of clause 13, wherein the upper loading mechanism comprises a product direction plate in communication with the dispensing lever.

15. The merchandiser of clause 1, further comprising an input port and a dispensing port.

16. The merchandiser of clause 15, further comprising a product input mechanism in communication with the input port and the product dispensing chute mechanism.

17. The merchandiser of clause 16, wherein the product input mechanism comprises a product carriage and a carriage drive device.

18. The merchandiser of clause 1, further comprising a controller and an input/output device and/or a printer and/or a communications device.

19. A method of dispensing a product from a merchandiser, comprising: maneuvering a lever to open a first pair of stopper plates and close a second pair of stopper plates so as to drop a first product into a bottom column position on the pair of second stopper plates; inserting a second product into a top column position; and maneuvering the lever to open the second pair of stopper plates to dispense the first product from the bottom column position and close the first pair of stopper plates to accept a third product thereon.

20. A super-chill merchandiser, comprising: an outer shell; a super-chill refrigeration system; a dispensing wheel positioned within the outer shell; and a ratchet mechanism to advance the product wheel.

21. The super-chill merchandiser of clause 20, wherein the outer shell comprises an input port and a dispensing port.

22. The super-chill merchandiser of clause 20, further comprising a dispensing lever positioned about the outer shell and in communication with the ratchet mechanism.

23. The super-chill merchandiser of clause 22, wherein the dispensing lever comprises a pair of input port arms and an input port plate.

We claim:

1. A merchandiser for dispensing a temperature controlled product from a number of different product brands in response to receiving an ambient product, comprising:

a temperature controlled compartment;

a product input system adjacent to the temperature controlled compartment; and a multi-chute product dispensing system, positioned within the temperature controlled compartment;

an X-Y drive device cooperating with the product input system and the multi-chute product dispensing system;

the multi-chute product dispensing system comprising a plurality of product chutes in communication with a dispense activation mechanism such that the X-Y drive device drops the ambient product into one of the plurality of product chutes and the dispense activation mechanism dispenses the temperature controlled product from the product chute.

2. The merchandiser of claim 1, further comprising an ambient product compartment.

3. The merchandiser of claim 1, wherein the product input system comprises an identification module.

4. The merchandiser of claim 3, wherein the identification module comprises an optical recognition device.

5. The merchandiser of claim 1, wherein the product input system comprises an input port and a reject port.

6. The merchandiser of claim 1, wherein the product input system comprises a reject selector and an input selector.

7. The merchandiser of claim 1, wherein the X-Y drive device comprises a product carriage with one or more movable product support bars therein.

8. The merchandiser of claim 7, wherein the product carriage maneuvers along one or more X drive rods and one or more Y drive rods.

9. The merchandiser of claim 7, wherein the plurality of product chutes comprises an activation lever that cooperates with the product carriage.

10. The merchandiser of claim 1, wherein the plurality of product chutes comprises a plurality of guide plate and a plurality of stopper plates.

11. The merchandiser of claim 1, wherein the dispense activation mechanism comprises a chute drive rail in communication with the plurality of product chutes.

12. The merchandiser of claim 11, wherein the dispense activation mechanism comprises a drive rod and a drive gear in communication with the chute drive rail.

13. The merchandiser of claim 1, wherein the temperature controlled compartment comprises a refrigerated compartment, a super-chilled compartment, and/or a heated compartment.

14. A method of dispensing a temperature controlled product upon receiving an ambient product, comprising:

optically identifying the ambient product;

releasing the identified ambient product into a temperature controlled compartment;

dropping the identified ambient product into a predetermined product chute of a multi-chute product system with a corresponding temperature controlled product via an X-Y drive device;

activating the predetermined product chute; and dispensing the corresponding temperature controlled product.

* * * * *